US008480446B2

(12) United States Patent
Woods

(10) Patent No.: US 8,480,446 B2
(45) Date of Patent: Jul. 9, 2013

(54) HIGH EFFICIENCY SWIM FIN USING MULTIPLE HIGH ASPECT RATIO HYDRODYNAMIC VANES WITH PLIABLE HINGES AND ROTATION LIMITERS

(76) Inventor: David W Woods, Orlando, FL (US)

( * ) Notice: Subject to any disclaimer, the term of this patent is extended or adjusted under 35 U.S.C. 154(b) by 196 days.

(21) Appl. No.: 12/939,393

(22) Filed: Nov. 4, 2010

(65) Prior Publication Data

US 2012/0115377 A1 May 10, 2012

(51) Int. Cl.
*A63B 31/08* (2006.01)

(52) U.S. Cl.
USPC ..... 441/64

(58) Field of Classification Search
USPC ..... 441/55, 60, 61, 62, 63, 64
See application file for complete search history.

(56) References Cited

U.S. PATENT DOCUMENTS

| | | | | |
|---|---|---|---|---|
| 107,376 | A | 9/1870 | Hunter | |
| 2,729,832 | A | 1/1956 | Schmitz | |
| 2,987,332 | A | 6/1961 | Bonmartini | |
| 3,081,467 | A * | 3/1963 | Ciccotelli | 441/63 |
| 3,084,355 | A | 4/1963 | Ciccotelli | |
| 3,122,759 | A | 3/1964 | Gongwer | |
| 3,411,165 | A | 11/1968 | Murdoch | |
| 4,097,958 | A | 7/1978 | Van Dell | |
| 4,178,128 | A | 12/1979 | Gongwer | |
| 4,209,866 | A | 7/1980 | Loeffler | |
| 4,738,645 | A | 4/1988 | Garofalo | |
| 4,767,368 | A | 8/1988 | Ciccotelli | |
| 4,781,637 | A | 11/1988 | Caires | |
| 4,944,703 | A * | 7/1990 | Mosier | 441/62 |
| 4,981,454 | A | 1/1991 | Klein | |
| 5,326,296 | A * | 7/1994 | De Jesus | 441/60 |
| 5,330,377 | A | 7/1994 | Kernek | |
| 5,536,190 | A | 7/1996 | Althen | |
| 5,634,613 | A | 6/1997 | McCarthy | |
| 5,746,631 | A | 5/1998 | McCarthy | |
| 6,290,561 | B1 | 9/2001 | Garofalo | |
| 7,462,085 | B2 | 12/2008 | Moyal | |
| 2009/0088036 | A1 | 4/2009 | Garofalo | |

OTHER PUBLICATIONS

ScubaPro Seawing Nova, retrieved on Nov. 9, 2010, retrieved from http://www.scubapro.com/americas/english/scubapro-products/fins/blade-fins/seawing-nova.

* cited by examiner

*Primary Examiner* — Daniel Venne
(74) *Attorney, Agent, or Firm* — Brian S. Steinberger; Law Offices of Brian S. Steinberger, P.A.

(57) ABSTRACT

Apparatus, devices and methods of operating multiple high aspect ratio hydrodynamic horizontal ladder oriented vanes with pliable hinges and rotation limiting flexible webs attached between flexible support beams on swim fins. The fins can have a foot pocket. A pair of parallel support beams can be secured to the foot pocket and support a plurality of hydrofoil vanes in a resisted pivotal arrangement. Pivotal rotation of the vanes can be restricted by flexible membranes, between vanes and beams, to provide an optimum angle of attack for the during swimming. The fins can have at least one pivoting vane region connected to the fin with a flexible hinge member.

11 Claims, 13 Drawing Sheets

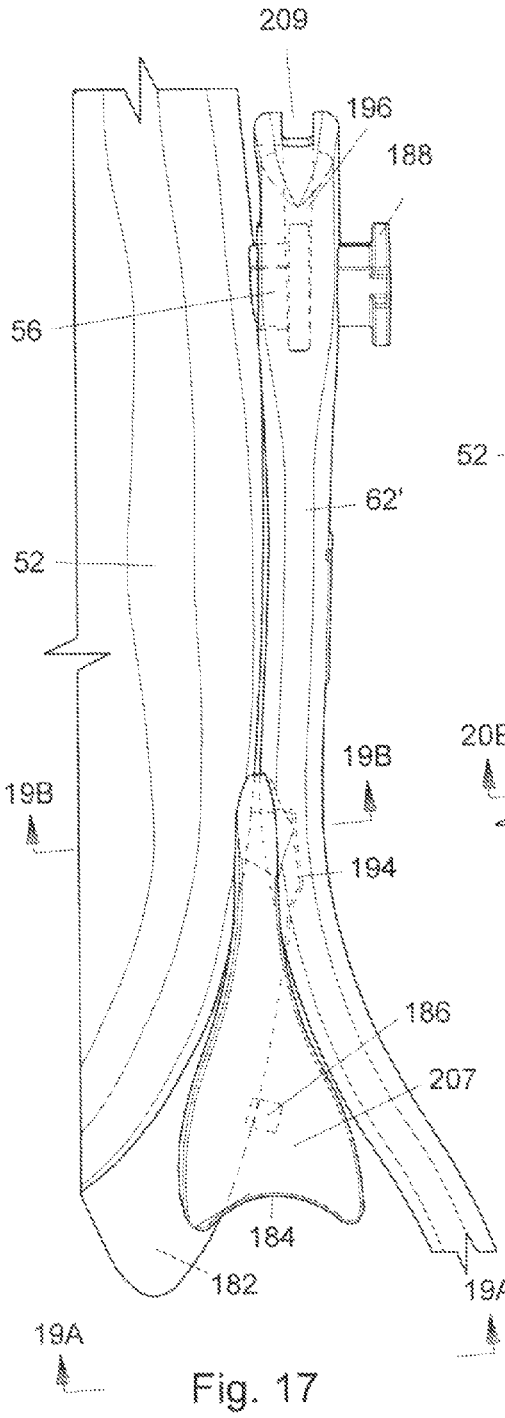
Fig. 17
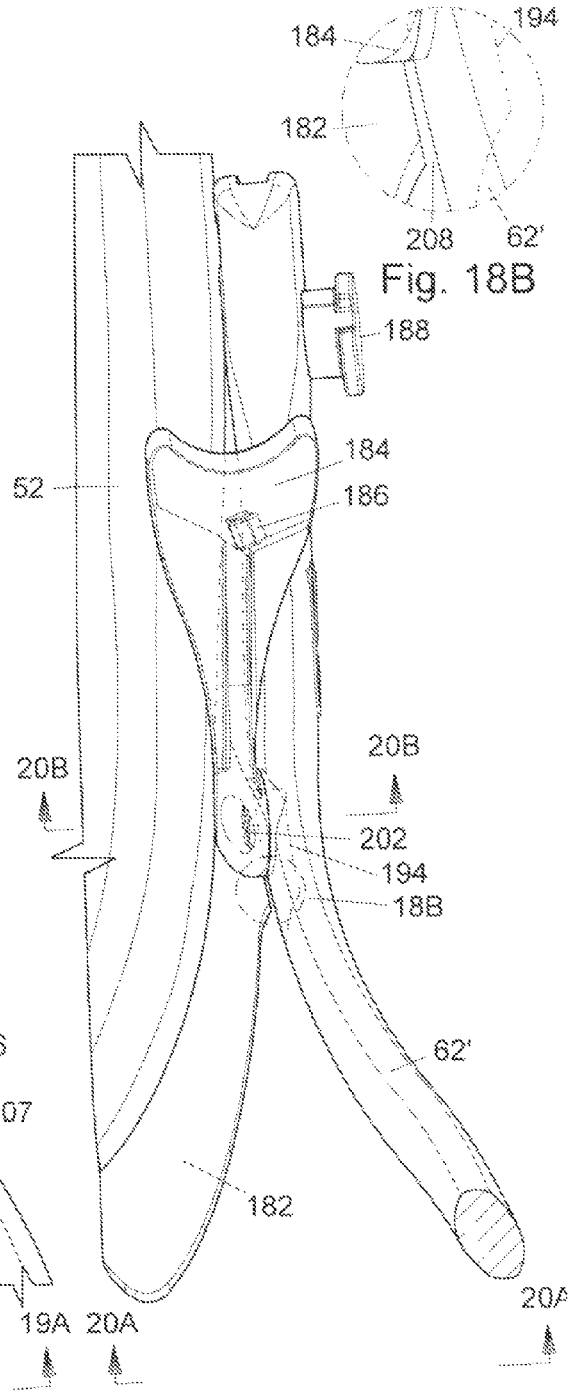
Fig. 18B
Fig. 18A

HIGH EFFICIENCY SWIM FIN USING MULTIPLE HIGH ASPECT RATIO HYDRODYNAMIC VANES WITH PLIABLE HINGES AND ROTATION LIMITERS

This invention claims the benefit of priority to U.S. Provisional Patent Application Ser. No. 61/280,375 filed Nov. 9, 2009.

FIELD OF INVENTION

This invention relates to swim fins, in particular to apparatus, devices and methods of using and operating multiple high aspect ratio hydrodynamic horizontal vanes with pliable hinge members and rotation limiting web members on swim fins.

BACKGROUND AND PRIOR ART

Over the years swimmers have been attempting to improve moving through water. Originally boards were attached to one's hands or feet, and have been used for over a hundred years with literally hundreds of variations. However, their hydrodynamic efficiency has been relatively poor in view of the difficulty of dealing with two human legs and allowing the fins to pass one another without collision. Current swim fins have evolved to an elongated flexible propulsion surface where their proliferation is mainly attributed to the ease of manufacture. All of these swim fins have suffered from problems of a very low aspect ratio and poor angle of attack. Other types of efficient swim assistance aids exist but have complexity and manufacturing costs that keep these aids from being used.

Earlier swim fin designs have problems with the aspect ratio and induced drag such as documented in U.S. Pat. No. 5,746,631 to McCarthy (1998) which is incorporated by reference. A substantial amount of induced drag is created by the transverse travel and vortex of fluid near the lateral edges of a lifting body (or foil) when that foil travels through a fluid. This induced drag reduces the effectiveness of the remainder of the foil. It has been established that a greater distance between the lateral edges improves the effective lift to drag ratio of the foil. The aspect ratio measures the separation of the lateral edges to the chord of the foil and is an indicator of the efficiency of the foil.

Most modern fins have an aspect ratio between 0.3 and 0.5. It is well known that a higher aspect ratio produces higher hydrodynamic efficiency. Many examples of this can be found in nature. Fish tails have widely varying aspect ratios. The fast swimming amberjack has a tail fin with an aspect ratio of about 8 while the much slower swimming grouper has an aspect ratio of about 1.5. Whales and dolphins have aspect ratios in the 5 to 6 range.

The angle of attack of a foil also affects the lift to drag characteristics of the foil. The angle of attack is the relative angle that exists between the actual alignment of the oncoming flow and the lengthwise alignment of the foil (or chord line). When this angle is small, the foil is at a low angle of attack. When this angle is high, the foil is at a high angle of attack. As the angle of attack increases, the flow collides with the foil's high pressure surface (also called the attacking surface) at a greater angle. This increases fluid pressure against this surface. While this occurs, the fluid curves around the opposite surface, and therefore must flow over an increased distance. As a result, the fluid flows at an increased rate over this opposite surface in order to keep pace with the fluid flowing across the attacking surface. This lowers the fluid pressure over this opposite surface while the fluid pressure along the attacking surface is comparatively higher. The pressure differential results in lift, or force causing it move in the direction of the low pressure.

A foil has an optimum angle of attack where the lift to drag ratio is the highest. When the foil is at a lower angle of attack than the optimum the lift is reduced with relatively little change in drag. When the foil is a higher angle of attack the drag increases substantially while the lift increases at a lesser rate. The increased drag is due to flow separation and the creation of turbulence on the low pressure side of the foil which is known as stalling. A typical optimum angle of attack for a foil is between 4 to 10 degrees. The angle of attack for most swim fins is 90 degrees which is in the stalled range and results in the swimmer having undue ankle stress and leg fatigue.

U.S. Pat. No. 2,729,832 to Schmitz described an improvement in efficiency by aligning the propulsion surface with the travel direction rather than the sole of the foot, but did not resolve low aspect ratio and extreme angle of attack having inefficiency created by vortices.

U.S. Pat. No. 107,376 to Hunter described a method for propelling ships using an oscillating rudder with multiple rubber propulsion vanes for ships.

U.S. Pat. No. 3,122,759 to Gongwer described improving performance with a very efficient high aspect ratio hydrofoil of about three feet laterally. The device resulted in propelling the swimmer in a straight line in open water but its size and complexity made it impractical for common sporting use.

U.S. Pat. No. 4,767,368 to Ciccotelli had a simpler high aspect ratio swim fin which was impractical for maneuvering in restricted areas and can cause significant stress on the swimmer's ankles due to the long lever arm from the ankle to the lifting vane. Generally, these high aspect ratio swim fins had protrusions which could snag underwater obstacles.

U.S. Pat. No. 4,781,637 to Caires described a high aspect ratio swim fin that required the swimmer to place both feet into the foot pocket requiring the swimmer to simultaneously kick both feet which was only useful in open water free of obstacles.

U.S. Pat. No. 4,178,128 Gongwer described a multi-vane hydrofoil shape swim fin to improve efficiency but required springs, hinges, and thin rods resulting in being mechanically complex, difficult to manufacture, prone to snagging underwater flora, and subject to abrasive wear from suspended grit.

U.S. Pat. No. 4,944,703 to Mosier showed a swim fin having multiple articulating hydrofoil vanes. However, the composite construction of internal rigid parts molded into less rigid parts resulted in expensive manufacturing costs. The 19 shown discrete parts in the figures indicate either manual assembly or a complex automated assembly line would be necessary resulting in expensive manufacturing costs. An implementation relied on pin and socket hinges and rubber inserts to control the articulation of the vanes which is subject to clogging and jamming by sand and other waterborne debris. The rigid side support beams would cause undue stress on the swimmer's ankles. The small gaps between the vanes and side beams and at the hinges are prone to trap stringy aquatic fauna and other stringy debris which may be encountered in the water creating a potential entrapment problem and a serious safety hazard.

An alternate embodiment in FIG. 6 of the Mosier '703 patent shows a resilient (rubber) hinge as the method of providing a rotational axis and self aligning of the vanes. However, this configuration would not work if physically constructed. Given the axial rotation desired of about 90 degrees as shown in FIG. 7 the axial length of the resilient hinge is too short to allow the rotation without overstressing the material and causing a shear failure. If the axial length were increased the narrow diameter would permit the vane to move out of alignment with the axis. The resilient hinge geometry has very high stress areas created at the interfaces between the softer and harder materials further increasing the likelihood of hinge failure. During operation, there would be no hard limit to the rotation of the vane. As more power is applied to the stroke, the vanes would rotate further reducing the effective lift of the vanes. Manufacturing would be difficult since five separately molded pieces would have to be hand placed in a second mold for the over molding process. Any manufacturing process which requires human interaction necessarily increases the cost.

U.S. Pat. No. 5,536,190 to Althen shows a propulsion method with an appropriate angle of attack using vane rotation limiters, high aspect ratio and plural vanes, but is hindered by many hinges and small parts which cause expensive manufacturing costs with the product prone to breakage and wear from captured grit. This device is impractical in aquatic environments since its parts can become entangled with flora.

U.S. Pat. No. 5,746,631 to McCarthy shows a fin with a longitudinal gap effectively creating a fin with propulsion surfaces which swing sideways during the power stroke. The apparatus reduces ankle stress but makes it difficult to attain higher rates of speed.

U.S. Pat. No. 3,084,355 to Ciccotelli uses narrow vanes which rotate along a transverse axis and are mounted parallel to each other in a direction that is perpendicular to the direction of swimming with vanes that are not hydrodynamically streamlined to generate lift, and no system is used to control tip vortices. The vanes are arranged so they only provide resistance to the kick during a small portion of the kicking stroke. When they are providing resistance they are effectively joined resulting in a lower aspect ratio vane than they are individually. Only two of the four vanes are functioning at any one time which leads to a cumbersome arrangement reducing the ability of the swimmer to control his attitude in a non-mobile condition. The device is overly complex and contains many small parts which are prone to corrosion, grit accumulation and snags.

U.S. Pat. No. 4,209,866 to Loeffler describes a thin pivotally mounted vane with reversibly effective streamline camber, but has a low aspect ratio which is known to have lower efficiency than higher aspect ratio vanes. The device was of complex construction with many wear points increasing the manufacturing and maintenance costs.

U.S. Pat. No. 5,330,377 to Kernek shows a swim fin with multiple connected surfaces creating channelized flow between them. The large surface area of the propulsion surfaces created sufficient viscous drag to cancel any gained benefit and the complex molding indicate a high fabrication cost.

U.S. Pat. No. 6,290,561 shows a swim fin with a propulsion surface supported by an elastic band and external beams. The elastic support restricts the maximum deflection of the propulsive surface but does nothing to control flow along the lateral surface edges. The edge vortices would create increased induced drag between the propulsion surface and support beams causing a reduction in efficiency compared to conventional swim fins.

U.S. Pat. App. 2009/0088036 to Garofalo shows a swim fin with restrained trailing edge and loose sides. The lack of a gap between the foot pocket and the vane eliminates the small benefit of its improved angle of attack. It includes "deformable folding side pockets which will be able not only to ensure a good "channel effect" but also to operate as deformation limiters." The long longitudinal length of the side pockets is sufficiently long that the vortex limiting capability is reduced. The volume of channelized flow is large enough that it creates a cushion effectively acting as a new hydraulic surface which forces the free flow to move laterally and create new edge vortices.

U.S. Pat. No. 5,634,613 to McCarthy shows tip vortex canceling devices and U.S. Pat. No. 3,411,165 to Murdoch and U.S. Pat. No. 4,738,645 to Garofalo use pleats with composite construction to increase local deflection of the propulsion surface. However, these swim fins have low aspect ratios with the problems previously described.

U.S. Pat. No. 4,981,454 to Klein and U.S. Pat. No. 7,462,085 to Moyal show swim fins with a hinge on the foot pocket allowing the propulsion surface to rotate upward against the swimmer's shin to facilitate simplified walking while wearing the device. However, these devices are limited in their efficiency since they use conventional flat low aspect ratio propulsion surfaces subject to all the problems previously described.

Hinges using rubber like substances to provide torsional resistance are shown in U.S. Pat. No. 2,987,332 to Bonmartini and U.S. Pat. No. 4,097,958 to Van Dell that use composites of rubber and metal. The metal provides support for the hinge while the rubber provides the torsional resistance. However, the metal parts are not practical in a salt water environment, and their geometry requires a relatively large area for the installation of the hinge which would reduce the area allotted for the attached vanes.

The ScubaPro Nova SeaWing swim fin uses a flexible support beam combined with a very flexible root section of the support beam which allows the entire support beam to rotate in excess of 30 degrees. Additional flexing of the support beam allows a total flex in excess of 40 degrees which is what is considered the optimum angle of attack. The SeaWing, while innovative, still suffers from adverse propulsion surface curvature, a low aspect ratio, the lack of a hydrodynamic lifting surface, and insufficient control of tip vortices.

Thus, the need exists for solutions to the above problems with the prior art.

SUMMARY OF THE INVENTION

A primary objective of the present invention is to provide apparatus, devices and methods of using and operating multiple high aspect ratio hydrodynamic horizontal vanes with pliable hinges and rotation limiters on swim fins used for swimmers or divers.

A secondary objective of the present invention is to provide apparatus, devices and methods of using and operating multiple high aspect ratio hydrodynamic horizontal vanes having few parts that are easy and inexpensive to manufacture.

A third objective of the present invention is to provide apparatus, devices and methods of using and operating multiple high aspect ratio hydrodynamic horizontal vanes which eliminates any snagging and abrasion in aquatic environments that were associated with closely associated moving parts used by fins in prior art aquatic environment.

A fourth objective of the present invention is to provide apparatus, devices and methods of using and operating multiple high aspect ratio hydrodynamic horizontal vanes that are easy to operate by swimmers in both salt water and fresh water applications, and has mobility on land.

A fifth objective of the present invention is to provide apparatus, devices and methods of using and operating multiple high aspect ratio hydrodynamic horizontal vanes that reduces stress on ankles and increases maneuverability of the swimmer, and increases efficiency of the effort of the swimmer, and increases foot angle efficiency.

A sixth objective of the present invention is to provide apparatus, devices and methods of using and operating multiple high aspect ratio hydrodynamic horizontal vanes that reduces tip vortex losses and results in a narrowly directed thrust.

A seventh objective of the present invention is to provide apparatus, devices and methods of using and operating multiple high aspect ratio hydrodynamic horizontal vanes that causes low environmental disturbances.

An eighth objective of the present invention is to provide apparatus, devices and methods of using and operating multiple high aspect ratio hydrodynamic horizontal vanes that uses reversible flexible vanes.

A ninth objective of the present invention is to provide apparatus, devices and methods of using and operating multiple high aspect ratio hydrodynamic horizontal vanes that can be manufactured by a one piece overmolding process.

A tenth objective of the present invention is to provide apparatus, devices and methods of using and operating multiple high aspect ratio hydrodynamic horizontal vanes that can be injection molded in two steps.

The invention improves the efficiency of a swimmer or diver in self propulsion through water by increasing the aspect ratio of the propulsion surfaces of swim fins while using a more hydrodynamic shape and maintaining a narrow mechanism width to allow normal swimming action and keeping the manufacturing cost and maintenance requirements low. The invention groups multiple high aspect ratio hydrodynamic vanes into a single fin, arranged in a ladder form between two side support beams. These vanes would be allowed to rotate on a lateral axis during the kicking stroke but the rotation would be resisted by a pliable rubber like hinge. The maximum rotation would be limited by a flexible rubber like web connected between the vanes' lateral edges and the support beams. The limiting webs would also serve as winglets to cancel a significant amount of vortex creation at the vane ends. Ankle stress would be reduced through the use of flexible support beams which would flex as greater pressure is applied thus reducing the lever arm to the ankles without substantially reducing the effective thrust.

The novel invention provides a controllable high efficiency swim fin which directs its thrust directly opposite the direction of travel without causing undue ankle stress or disturbance to the surrounding water. The pliable hinge eliminates the need for a conventional pin and hole type hinge which involves additional assembly steps during manufacture. The pliable hinge makes it possible to manufacture the entire mechanism through injection molding in two steps, a process known as overmolding. This results in a substantial reduction in production cost. The lack of closely associated moving parts eliminates snagging and abrasion associated with them in the aquatic environment. Unlike the prior art, this invention does have closely associated moving parts and instead uses connections of flexible materials so there is no possibility of things getting caught between connected parts.

An embodiment of a novel fin apparatus for increasing the efficiency of a swimmer or diver during self propulsion through water, can include a plurality of high aspect ratio dynamic vanes arranged in a ladder configuration, each vane having a left end and a right end, two side beams, each arranged to both side ends of the ladder configuration of vanes, a plurality of pliable hinges that attach the ends of the vanes to the side beams, the hinges allowing the vanes to rotate on a lateral axis during a kick stroke and be resisted by the pliable hinges, and a plurality of flexible webs that attach the ends of the vanes to the side beams, the flexible webs allowing for limiting a maximum rotation of the vanes, and serve as winglets to cancel a significant amount of vortex creation at the vane ends, wherein ankle stress is reduced through using the support beams which would flex as greater pressure is applied thus reducing the lever arm to the ankles without substantially reducing the effective thrust, resulting in a high aspect ratio, increasing the efficiency of the swimmer.

The pliable hinges can be formed from the group selected from one of: rubber, silicone rubber, polyvinylchloride, Polyurethane, Polybutadiene, Chlorosulphonated Polyethylene, and neoprene.

The flexible webs can be formed from the group selected from one of: rubber, silicone rubber, polyvinylchloride, Polyurethane, Polybutadiene, Chlorosulphonated polyethylene, and neoprene, and the like.

The flexible side beams can be formed from the group selected from one of: Polyvinyl chloride, polypropylene, Acrylonitrile butadiene styrene, nylon, polyethylene, rubber and neoprene, and the like.

Each of the vanes can be a laterally oriented vane, and each of the vanes can be formed from the group selected from one of: Polyvinyl chloride, polypropylene, Acrylonitrile butadiene styrene, nylon, polyethylene, rubber and neoprene, and the like.

The pliable hinges can include a connection shaft attached at one end to one of the side beams and a second opposite end attached to one of the ends of the vane, and a pliable material overmolded over the connection shaft. Each of the pliable hinges can include a generally cylindrical or elliptical configuration with concave curved sidewalls. Each of the pliable hinges can have a generally cylindrical or elliptical configuration with concave curved sidewalls, and each of the flexible webs has a generally trapezoidal configuration. The pliable hinges can also formed without a connection shaft.

The side beams can be flexible side beams as well as be rigid side beams, where flexible side beams can reduce stress and strain on the users' ankles.

The novel fin can include a foot pocket attached to one end of the side beams, and a pivoting portion for allowing the side beams with the vanes to flip up relative to the foot pocket, in order to allow the user to walk with the fins.

A novel method of improving the efficiency of a swimmer or diver in self propulsion through water, can include the step of increasing aspect ratio of propulsion surfaces of a swim fin while using a more hydrodynamic shape and maintaining a narrow mechanism width to allow normal swimming action and keeping the manufacturing cost and maintenance requirements low.

The step of increasing the aspect ratio can include the steps of grouping a plurality of high aspect ratio hydrodynamic vanes into a single fin, arranging the plurality of the vanes horizontally in a ladder configuration between side support beams, rotating the vanes along a lateral axis wherein rotation is limited by pliable hinges attached between each of the vanes and the side beams, and limiting maximum rotation of the vanes along the lateral axis by flexible webs that are attached between each of the vanes and the side beams. The limiting step can include the step of using the flexible webs as winglets to cancel significant amounts of vortex creation at the vane ends.

The method can further include the steps of providing flexible side support beams as the side support beams, and reducing ankle stress through the use of flexible beams which flex as greater pressure is applied and reduce the lever arm to ankles without substantially reducing the effective thrust.

The method can include the step of directing thrust with the fin opposite direction of travel without causing undue ankle stress or disturbance to surrounding water.

The method can further include the steps of providing a foot pocket attached to one end of the side beams, providing a pivoting member between the foot pocket and the one end of the side beams, and flipping up the side beams with the vanes in order to allow the user to walk while wearing the fins.

Further objects and advantages of this invention will be apparent from the following detailed description of the presently preferred embodiments which are illustrated schematically in the accompanying drawings.

BRIEF DESCRIPTION OF THE FIGURES

FIG. 17 is a plan view of a latching system for the pivotally attached support beam embodiment with the cam lever in the latched position.

FIG. 18A is a plan view of a latching system for the pivotally attached support beam embodiment with the cam lever in the un-latched position.

FIG. 18B is a detail of FIG. 18A showing the gap created when the cam lever is operated.

DESCRIPTION OF THE PREFERRED EMBODIMENTS

Figure 1:
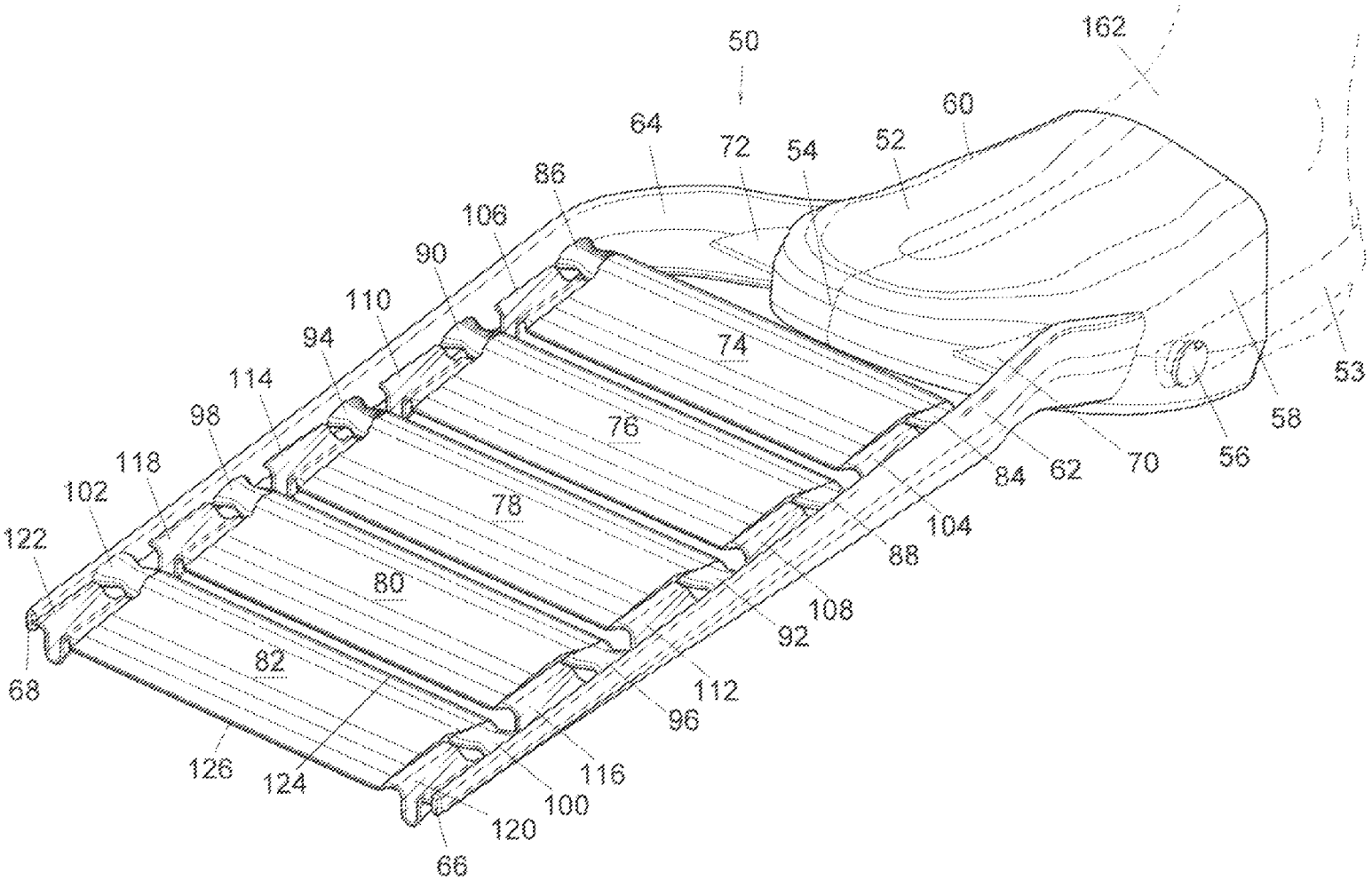
FIG. 1 is a perspective view of a first embodiment of the novel fin apparatus invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention claims the benefit of priority to U.S. Provisional Patent Application Ser. No. 61/280,375 filed Nov. 9, 2009, which is incorporated by reference.

A list of the components will now be described.

50 symmetric vane fixed support beam swim fin
52 foot pocket
53 foot strap
54 toe portion
56 foot strap peg
58 left side
60 right side
62 support beam L
64 support beam R
66 end portion L
68 end portion R
70 flow guide L
72 flow guide R
74 vane 1
76 vane 2
78 vane 3
80 vane 4
82 vane 5
84 hinge 1 L
86 hinge 1 R
88 hinge 2 L
90 hinge 2 R
92 hinge 3 L
94 hinge 3 R
96 hinge 4 L
98 hinge 4 R
100 hinge 5 L
102 hinge 5 R
104 web 1 L

106 web 1 R
108 web 2 L
110 web 2 R
112 web 3 L
114 web 3 R
116 web 4 L
118 web 4 R
120 web 5 L
122 web 5 R
124 leading edge
126 trailing edge
128 connection shaft
130 beam hinge base
132 vane hinge base
134 vane hinge hole
136 web connection slot
138 web connection rail
140 beam hub
142 beam hub wing
144 beam hub wing hole
146 hinge axis point
148 oblong hole
150 front of web
152 rear of web
154 connection bump
156 flow
158 user's leg
160 heel
162 foot
164 maximum flexure
166 direction of foot motion
168 support beam deflection
170 lift
171 flexible vane fixed support beam swim fin
172 flexible connector
174 rigid leading edge
176 rigid trailing edge
178 rail system
180 flexible vane
182 latch ledge
184 cam lever
186 lock clip
188 replacement foot strap peg
190 cam lever rotation
192 beam rotation
194 latch slot
196 foot strap peg receptacle
198 keyway
200 tab
202 cam lever post
204 shoulder
206 cam pivot hole
207 broad upper surface
208 gap
209 receptacle back opening
210 symmetric vane pivotally attached support beam swim fin
212 left latch assembly
214 right latch assembly
216 flexible vane pivotally attached support beam swim fin

First Embodiment

FIG. 1 is a perspective view of a first embodiment of the novel fin apparatus invention showing a fixed rail swim fin 50. A foot pocket 52 can include a common usage foot strap 53. Foot pocket 52 can include a toe portion 54 and one of a pair of outwardly extending lateral foot strap peg 56. Foot pocket 52 further defines a left side 58 and right side 60. Fixedly attached to the left side 58 and right side 60 of the foot pocket 52 can be a pair of elongated support beams 62 and 64 which extend toward the toe portion 54 of the foot pocket 52 and terminate in rounded end portions 66 and 68 respectively. A pair of flow guides 70 and 72 can extend laterally between the foot pocket 52 and support beams 62 and 64 respectively.

The support beams 62 and 64 are generally parallel and define therebetween a uniform space. A plurality of hydrofoil vanes 74, 76, 78, 80 and 82 can be pivotally secured between support beams 62 and 64 by a plurality of pliable hinges 84, 86, 88, 90, 92, 94, 96, 98, 100 and 102. The first embodiment can have five vanes 74-82 that are each pivotally supported by pairs of pliable hinges 84-102. The hydrofoil vane 74 nearest the toe portion 54 is secured by a hinge 84 to support beam 62 and by a hinge 86 to support beam 64. Similarly, vane 76 is secured by hinges 88 and 90 to support beams 62 and 64 respectively and vanes 78, 80, and 82 are secured to support beam 62 by hinges 92, 96, and 100 respectively and to support beam 64 by hinges 94, 98, and 102 respectively. Each hydrofoil vane 74 through 82 can also be flexibly attached to support beams 62 and 64 by a plurality of pliable webs 104, 106, 108, 110, 112, 114, 116, 118, 120 and 122 which are described in greater detail below. The hydrofoil vane 74 nearest the toe portion 54 is secured by a web 104 to support beam 62 and by a web 106 to support beam 64. Similarly, vane 76 is secured by webs 108 and 110 to support beams 62 and 64 respectively and vanes 78, 80, and 82 are secured to support beam 62 by webs 112, 116, and 120 respectively and to support beam 64 by webs 114, 118, and 122 respectively. In accordance with an important aspect of the present invention and as is described below in greater detail, hydrofoil vanes 74 through 82 define high aspect ratio hydrofoils in which their individual transverse or lateral dimensions are substantially greater than their widths in the flow direction.

The cross section of the five shown hydrofoil vanes 74 through 82 generally conform to airfoil shapes NACA (National Advisory Committee of Aeronautics) 0009 to NACA 0012, alternative airfoil shapes having high aspect ratios could also be used. Support beams 62 and 64 defines a plurality of molding connection points which are hidden from view under the hinges 84-102 and webs 104-122 in FIG. 1 and are shown and described in subsequent figures. The lateral ends of the vanes also contain a plurality of molding connection points which are hidden from view under hinges 84-102 and webs 104-122 in FIG. 1, and are also shown and described in subsequent figures.

A preferred embodiment of the novel swim fin 50 can be fabricated from a resilient semi-rigid molded plastic or rubber material and a more pliable plastic or rubber for the hinges 84-102 and webs 104-122. Alternatively, other materials resulting in similar results can be used.

The foot pocket 52 can receive the swimmer's foot such that the swimmer's foot 162 extends into interior cavity with the swimmer's toes situated within toe portion 54 after which it is secured by a strap system 53 to foot strap peg 56 that is known in the field. In accordance with conventional swim fin fabrication techniques, the strap system 53 can include an adjustment to accommodate foot size variations. Furthermore, the axes of support beams 62 and 64 in their elongated direction can be angularly displaced with respect to foot pocket 52 in a downward direction. This angular displacement can be seen in FIGS. 6A-10C and is to compensate for the typical angular relationship between a swimmer's leg and foot due to the restriction of ankle movement. As a result, support beams 62 and 64 are generally aligned with the swimmer's leg for more efficient stroking action.

The novel hydrofoil vanes 74-82 can be secured with hinges 84 through 102 in a limited travel pivotal attachment in which hydrofoil vanes 74-82 are pivotally movable about their respective hinges within a limited angular motion which is restricted by their respective webs 104-122. The vanes 74-82 are torsionally biased to assume the position shown in FIG. 1 in which the vanes 74-82 are substantially aligned with the major axis of support beams 62 and 64. In the absence of a stroking motion, this torsionally biasing force operative upon vanes 74-82 urges the vanes to the aligned position shown in FIG. 1.

The pivotal attachments of vanes 74-82 to support beams 62 and 64 can be positioned forward of the center lines of the hydrofoil vanes 74-82 at approximately 15% of the chord distance from the leading edge 124 toward the trailing edge 126 of each vane. Accordingly, substantial motion of the present invention swim fin in either direction causes vanes 74-82 to be pivoted to a desired angular position with respect to support beams 62 and 64. While the pivotal action of vanes 74 through 82 described in detail, the hydrofoil vanes 74-82 align with the appropriate angle of attack in response to the hydrodynamic pressure created during the movement of the fin through the water. The pivotal motion of the hydrofoil vanes 74-82 to the desired angle of attack simultaneously reduces the resistance of the water against fin motion thereby making the stroke easier for the swimmer and concurrently develops a localized area of higher flow velocity and reduced pressure along the front sides of each of the hydrofoil vanes. The reduced pressure on the front sides of the hydrofoil vanes 74-82 then produces a forward thrust component for increased efficiency of the swim fin.

During each stroke of swim fin the motion of the swim fin through the water aligns vanes 74-82 at the appropriate angle and the stroke action causes a flow of water across the angled vanes 74-82 producing a forward thrust carrying the swimmer forward. In the event of a small motion of the swim fin in either direction the torsional resistance of the pliable hinges 84-102 allows the vanes 74-82 to rotate partially toward the desired angular position and, in doing so, allows flow between the vanes 74-82 creating a smaller amount of forward thrust through the hydraulic mechanics previously described.

FIGS. 2A, 2B, 2C, 2D and 2E show a representative portion of support beam 62 and vane 82 showing the attachment surfaces for the pliable hinges and pliable webs that are not shown. These figures show the connection at hinge 100 and web 120 as shown in FIG. 1. The vane 80 nearer the foot pocket in FIG. 1 is not shown for clarity. All of the other attachment hinge and web locations are similar.

A hinge base 130 can be centered at the location on the support beam 62 which would be laterally aligned with the hinge axis point 146 (shown in FIG. 2B) of the vane 82. The hinge base 130 can include a beam hub 140 with two hub wings 142 with holes 144 through each as described below. The rail hub 140 can have a tapered cylindrical shape with a height equivalent to approximately ¼ of the gap between the support beam 62 and the vane 82 with a diameter such as to provide sufficient coverage by the hinge pliable material (not shown) to prevent tearing under stress. The covering thickness can depend on the specific material used and expected rotation of the hinge.

Connected to the rail hub 140 and in line with the longitudinal axis of the support beam 62 can be a pair of hub wings 142 on opposing sides of the rail hub 140. Their thickness is about half of their height and their height can be equivalent to that of the rail hub 140. The hub wings 142 can be rounded on their free corner with a radius equivalent to the height of the rail hub 140. Each hub wing 142 can be pierced perpendicular to its major plane by a hole 144 with a diameter equivalent to half of the height of the huh wing 140. The holes 144 can provide for a mechanical connection of the pliable material of the hinge. The hinge base 130 can be connected to the vane hinge base 132 by an elongated connection shaft 128 extending laterally from the top of the rail hub 140. On both sides of the vane hinge base 132 can be vane hinge holes 134.

The diameter of the connection shaft 128 can be the minimum sufficient to allow plastic material to flow through the mold tool. The connection shaft 128 serves the purpose of holding the parts together during the molding process and it should be sufficiently small in diameter to allow it to twist through a rotation of about 90 degrees repeatedly without breaking. Alternatively, the shaft 128 can be allowed to break after a number of articulations but the shaft 128 is at the center of rotation of the hinge so it will have no effect on the effectiveness of the pliable hinge.

All the edges can be rounded to reduce stress concentration in the pliable hinge material. While this description covers a configuration of the hinge bases, 130, 132 other geometries can be used to accomplish a similar function and this invention is not dependant on this particular configuration.

This first embodiment illustrates the substructure necessary in the event a simple fusion bond between the firm and pliable materials is not sufficiently strong by itself to prevent separation of the materials when under stress. An alternate configuration is described in FIG. 5C where the fusion bond alone is sufficiently resilient. A key element in reduction of the manufacturing cost is minimizing the handling of individual pieces of the unfinished product. To this end all of the firm parts are intended to be injection molded at one time and are connected to each other. The connection is clearly shown as the connection shaft 128.

Laterally piercing the support beam 62 between the hinge base 130 and end portion 66 are web connection slots 136 with a thickness approximately equivalent to the thickness of the web 120. Opposite the slots 136 can be a web connection rail 138 on the vane 82. The slots 136 a length of about 1.5 times the spacing between the slots 136 to assure sufficient material remains in the support beam 62 to minimize structural degradation of the support beam 62.

Figure 2A:
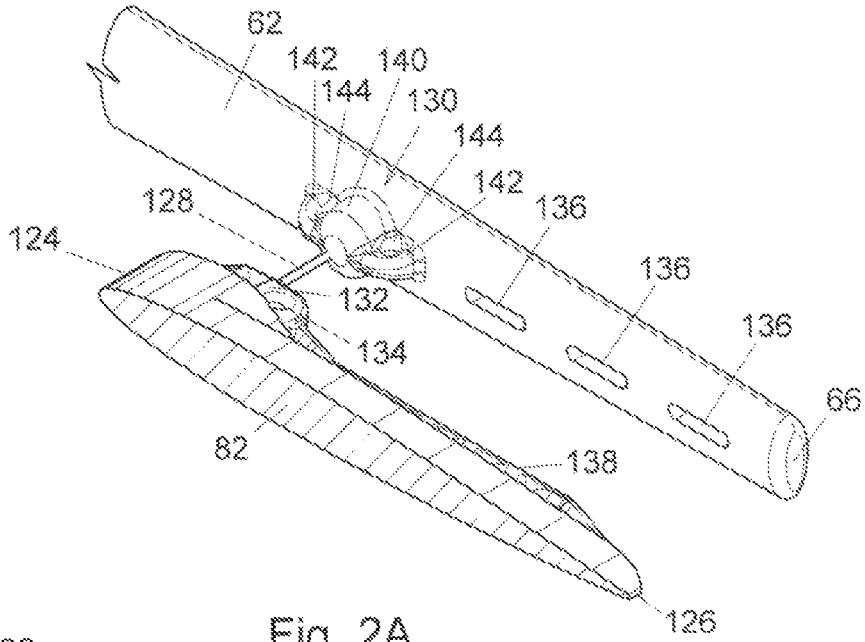
FIG. 2A is an isometric view of one vane-beam connection with the outer pliable hinge and web removed for visibility.
Figure 2B:
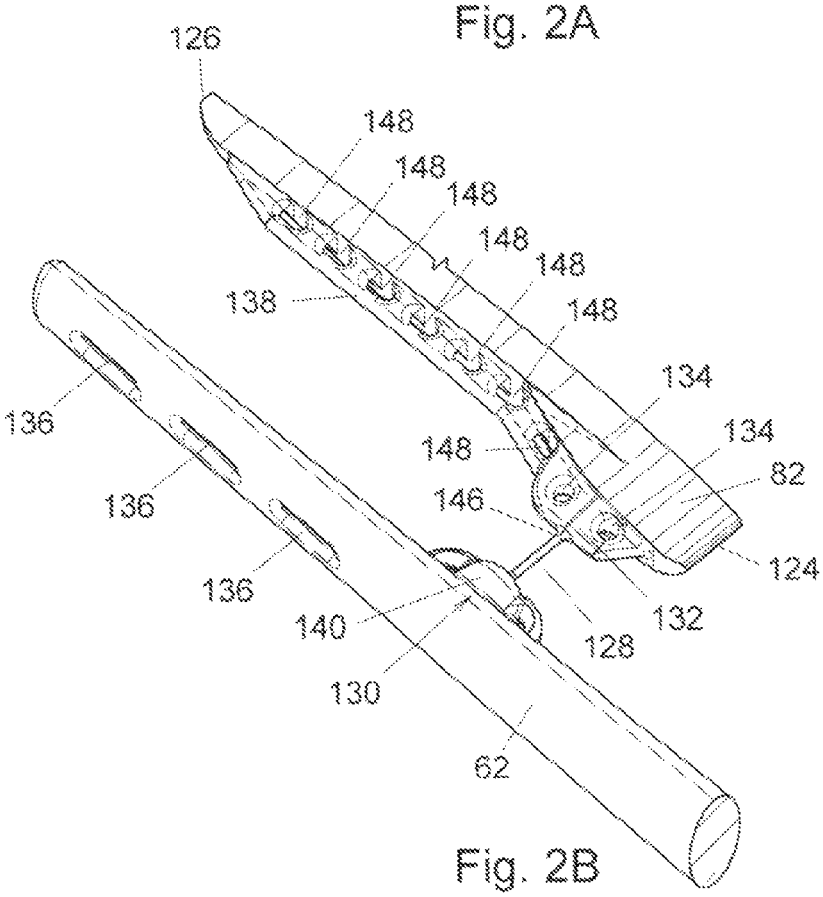
FIG. 2B is an isometric overhead view of the one vane-beam connection of FIG. 2A.
Figure 2C:
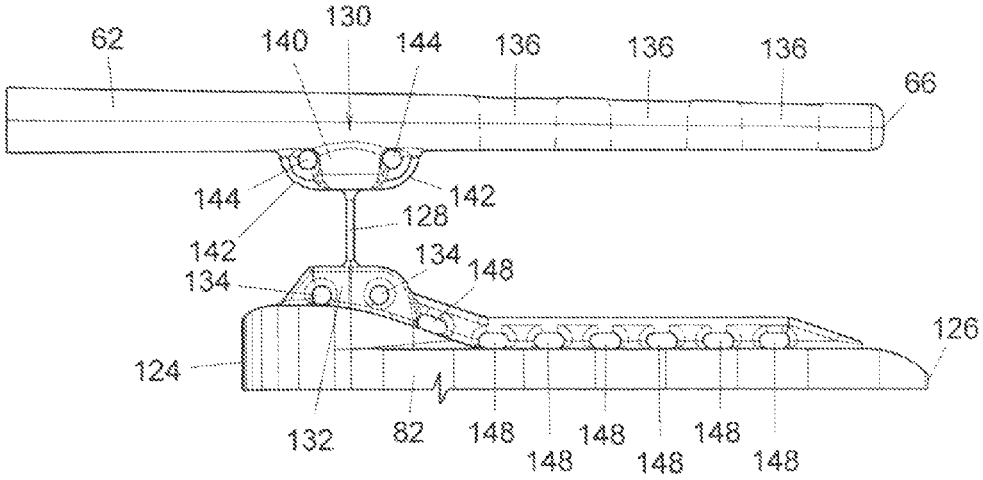
FIG. 2C is a plan view of the one vane-beam connection of FIG. 2A.
Figure 2D:
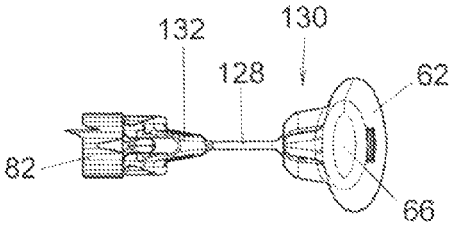
FIG. 2D is a rear view of the one vane-beam connection of FIG. 2A.
Figure 2E:
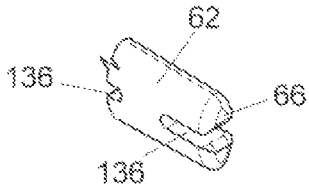
FIG. 2E is an isometric view of the one vane-beam connection of FIG. 2A with an alternate web slot configuration.

A preferred version shown in FIG. 2E would be enhanced by having one slot 136 piercing the end portion 66 to provide better support for the pliable web material.

FIG. 2B shows FIG. 2A from another overhead vantage point which makes the edge of the vane 82 more visible. Centered on the hinge axis point 146 at approximately 15% of the chord length of the vane 82 from the leading edge 124 is the vane hinge base 132 which is described below in greater detail. The vane hinge base 132 is a part of the vane 82 on the lateral edge which is a protrusion with a height of approximately ¼ of the lateral width of the hinge and with a thickness which is similar to the thickness of the vane 82 at the hinge axis point 146 less the required thickness of the pliable hinge material overlay as described and shown in FIG. 2A. The longitudinal length of the vane hinge base 132 is approximately three to four times its height and it is rounded on the free corners. A plurality of holes 134 can pierce the vane hinge base 32 to create additional mechanical connection between the vane 82 and pliable hinge material.

A web connection rail 138 runs along the centerline of the lateral edge of the vane 82 the height of which is approximately two times the thickness of the web 120 and is perforated with oblong holes 148 half of the connection rail height.

The connection rail 138 tapers to no height near the trailing edge 126. Since the connection rail 138 provides additional stiffness to the web 120 the connection rail 138 is on a base which is offset from the support beam 62 an additional distance approximately equivalent to the height of the rail 138.

The first embodiment of the swim fin 50 as shown in FIG. 1 improves human in water self propulsion by utilizing the benefits of high aspect ratio vanes while maintaining a relatively narrow overall width. Initially the swim fin operates similar to many swim fins already available in the marketplace. It has a foot pocket 52 for attachment to the user's foot with a foot strap 53 to keep it attached during use. This feature is common to most swim fins and is not considered unique in this invention but a base on which the other features are built. Beams 62, 64 attached to the left side 58 and right side 60 of the foot pocket 52 serve as support frame for the hydrodynamic vanes 74-82. In this embodiment the beams 62, 64 are essentially parallel to allow all the vanes 74-82 to be equal in width but that feature is not necessary for the overall function of the invention. Some variation in the width between the beams 62, 64 for aesthetic purposes would not substantially degrade the performance of the invention.

Figure 7A:
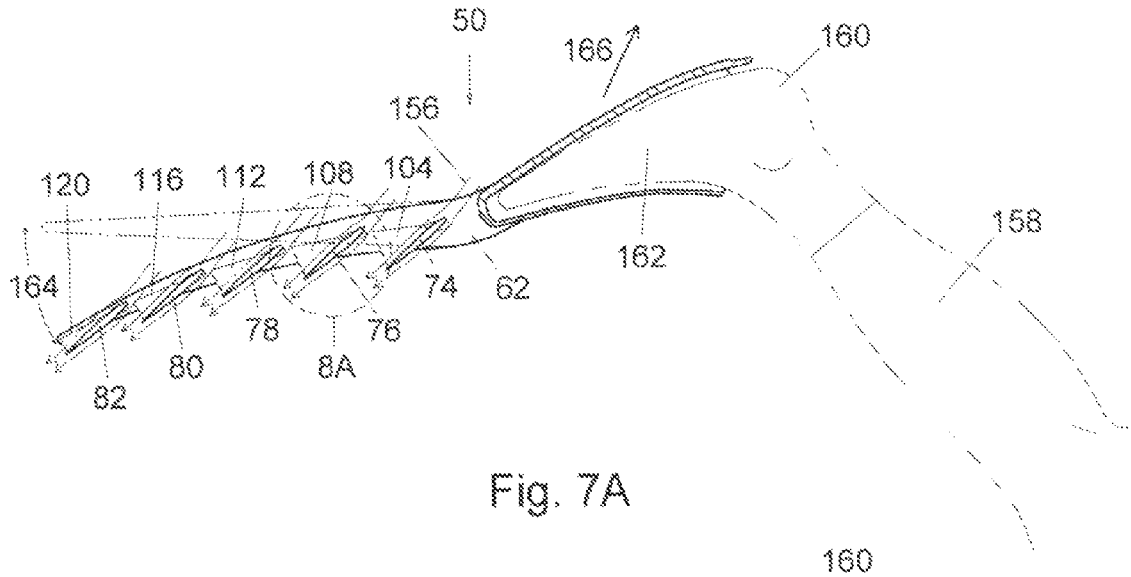
FIGS. 7A, 7B and 7C show an operational sequence of the first embodiment of the preceding figures using symmetrical rigid vanes.
Figure 7B:
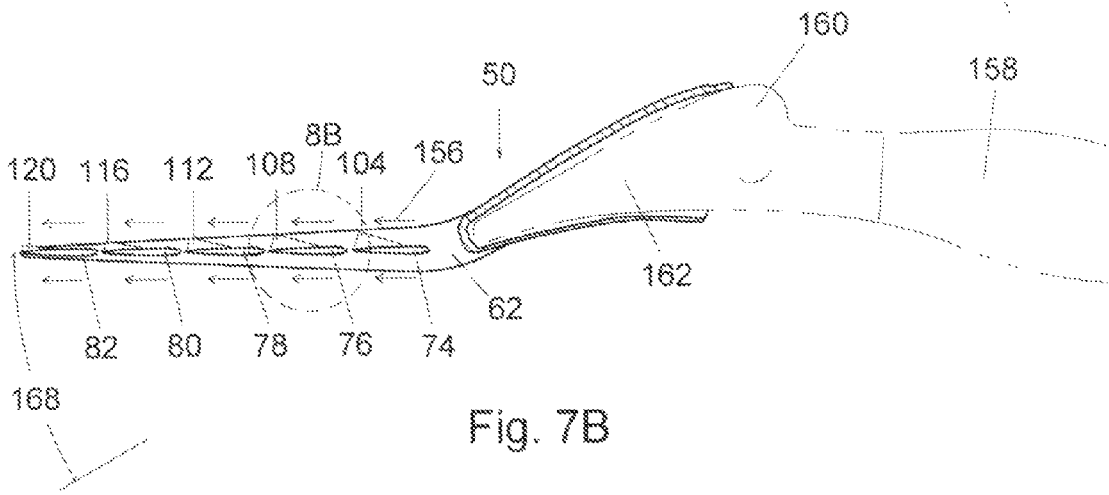
Figure 10A:
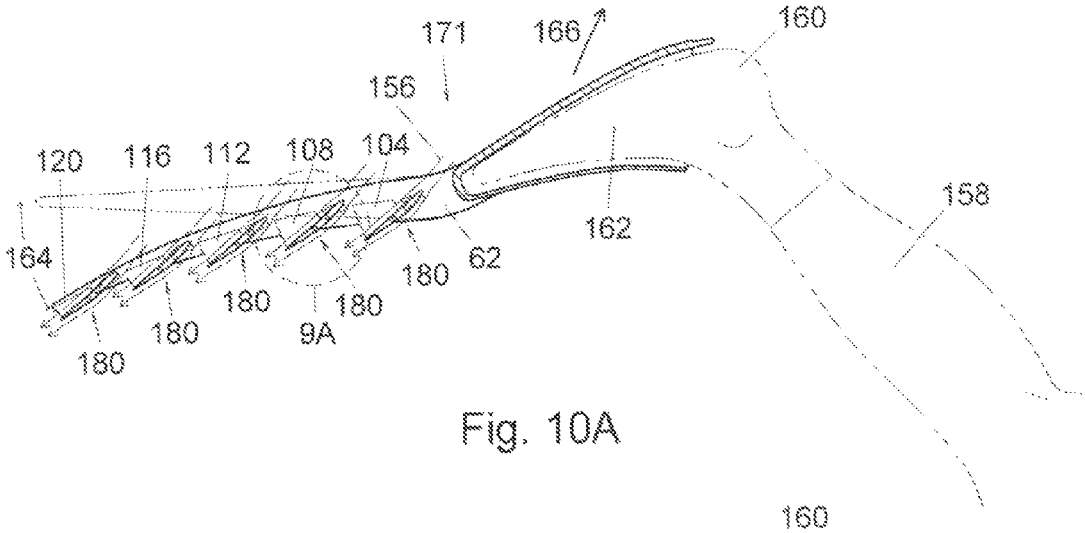
FIGS. 10A, 10B and 10C show the operational sequence of another embodiment of the invention using symmetrical flexible vanes.
Figure 10B:
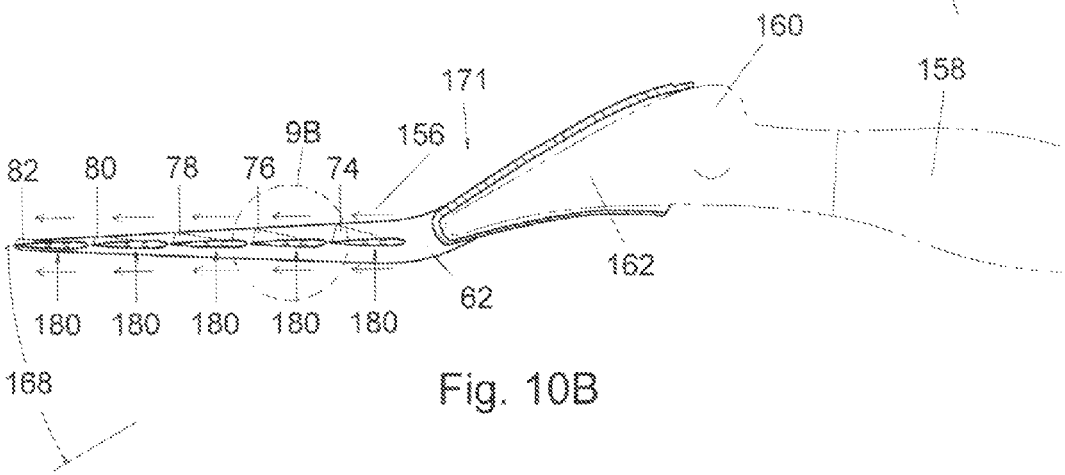

Because the user's foot 162 is not normally in line with the direction of travel of the user, the support beams 62, 64 deflect downward about 30 degrees such that they are substantially aligned with the axis of the user's leg 158 (FIG. 7B or 10B) when in a neutral position such as when coasting as shown in FIGS. 7B and 10B.

It is well known that an improperly sized swim fin will not perform well regardless of how efficient it is. Testing has revealed a total projected propulsive surface area of approximately 90 to approximately 100 square inches provides a comfortable balance between propulsive effort and actual forward speed. It is also known the width of a swim fin assembly should not exceed approximately 9.5 inches for widths in excess of this often collide during use. Consequently, the composite length of the vane array is the desired propulsive area divided by the available width between the support beams 62, 64.

The number of vanes 74-82 can be determined by the strength of the materials selected for their construction and the vane thickness to chord ratio. Stronger materials will allow thinner vanes. Computational fluid dynamics computer modeling of various vane shapes has revealed lift to drag ratios improve as the thickness to chord ratio decreases.

Given the limitations of unreinforced plastic like materials it was found that NACA (National Advisory Committee of Aeronautics) 0009 to NACA 0012 airfoils work well. The NACA airfoil 4 digit designation describes the shape of an airfoil based on its camber as a percentage of the chord (first 2 digits) and the maximum thickness (occurring at 30% of the chord) as a percentage of the chord length (last 2 digits). Thus a NACA 0009 airfoil is symmetrical (00) with a maximum thickness of 9% of the chord length (09). NACA is not the only designation for airfoil shapes and not all airfoil shapes have been tested so there can be other airfoil shapes which could also be applied to this invention. Division of the actual vane thickness required given the materials selected by the vane thickness to chord ratio of the airfoil shape will then yield the physical chord of the vane. Dividing the length of the propulsive area by the airfoil chord length will reveal the number of vanes which can be installed.

A major problem with previous swim fin designs is the angle of attack of the propulsive surface which is resolved with this invention by separating the propulsive surface or vanes 74-82 from the foot pocket 52 and allowing them to rotate toward the direction of foot motion 166 (FIGS. 7A, 7C, 10A, 10C). This is accomplished by pivotally connecting the vanes 74-82 to the support beams 62, 64. The problem of limiting the vane rotation to the optimum angle of attack is resolved by connecting the rearward portion of the lateral edges of the vanes 74-82 to the support beams 62, 64 with the pliable limiting webs 104-122 shown in FIG. 1.

In the past post and hole type hinges were used to allow rotation of the vanes but these were subject to problems of grit inclusion and snagging of waterborne debris. Additionally, a free swinging hinge would necessarily allow portions of the swimming stroke where no propulsive force would be generated. That portion is mostly during the transition in direction of the stroke where the vane pivots between the optimal angle of attack in one direction to the optimum angle of attack in the opposite direction. Videos of testing has revealed this transition portion to include as much as 30% of the stroke. All three of these issues were resolved through the use of the novel pliable hinges 84-102 shown in FIG. 1.

The novel pliable hinges 84-102 have no sliding interface to get clogged with grit, no gaps to allow snagging of waterborne debris, and the vanes 74-82 are always torsionally biased to the neutral position providing some lift component even during the transitional stages of the swimming stroke. The torsional bias to the neutral position provides another benefit of encouraging some propulsive lift with small foot movements. Small foot movements are often used by swimmers while remaining stationary to maintain one's attitude in the water or for maneuvering.

FIGS. 2A-6D show the construction of the hinge and web. Previously, all multivane swim fin devices have relied on many discrete parts and often small parts. The interfaces between these parts have often involved relative motion in contact resulting in wearing surfaces and subsequent part failure. Few of the previous multivane swim fin devices have made it to commercial production due to the high production cost involved with assembly of multiple parts. The subject invention uses a common two step overmolding process to fabricate the entire swim fin as a single part thus eliminating much of the previously required fabrication costs.

One of the key elements to inexpensive overmolding is maintaining the alignment of the parts as they are transferred from one mold tool to the next. This is accomplished with the connection shaft 128 between the support beam 62 and vane 82 as shown in FIGS. 2A-2D. This shaft 128 can be sized as small as possible to allow support of the parts during handling, allow repeated pivot about its axis up to 90 degrees, and allow molding material to flow through without creating a cold joint. Due to the torsional resistance created by the pliable hinge it is necessary to assure a good bond between the hinge 100 and the support beam 62 and vane 82. To this end the beam hinge base 130 is formed on the support beam 62 and the vane hinge base 132 is formed on the lateral edge of the vane 82. These bases 130, 132 serve to increase the surface area for bonding contact and holes 134, 144 through the bases provide additional mechanical bonding. The bases 130, 132 shown here are only one example of a method to improve bonding between two materials, there are others methods which will also work and this invention is not limited to this single example. The web 120 is subject to substantial tension and flexural stresses where they bond to the support beam 62 and vane 82. To accommodate these stresses web connection slots 136 are incorporated in the support beam 62 and a web connection rail 138 is incorporated into the vane(s) 82. These provide increased surface area for bonding contact. Holes 148 through the web connection rail 138 provide additional mechanical bonding to the web. The spacing of the web connection slots 136 is such as to cause little decrease in the flexural properties in the support beam 62.

Figure 3:
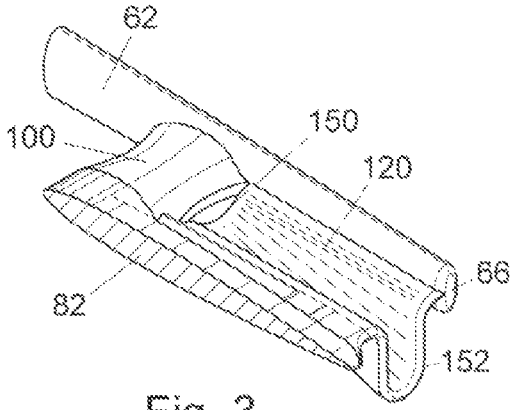
FIG. 3 is an isometric view of the novel hinge and web interconnection between the support beam and vane in a neutral position.

FIG. 3 shows the neutral position of the pliable hinge 100 and pliable web 120 installed over the features in FIG. 2 attached to the support beam 62 and vane 82. The nominal thickness of the material for the web 120 can vary depending on the particular substance from which it is fabricated. If it were made out of neoprene the thickness of the web would be approximately 0.07 inches. Other materials or even fabric could be used for this feature and would have a substantial effect on the necessary thickness and attachment method.

The web(s) 120 can have a generally trapezoidal sheet configuration in its rotated position with its lateral edges attached to the vane(s) 82 and support beam 62. The web(s) in its neutral position can have a generally gently folded sheet form with a small drape at its front of web 150 and a large drape at its rear of web 152.

The hinge(s) 100 can have a generally cylindrical or elliptical configuration with concave curved sidewalls.

Figure 4A:
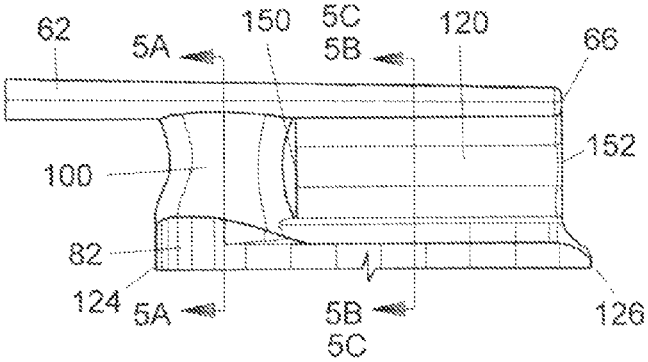
FIGS. 4A, 4B and 4C are plan profile and side views of the novel hinge and web interconnection and the support beam and vane of FIG. 3 in its neutral position.
Figure 4B:
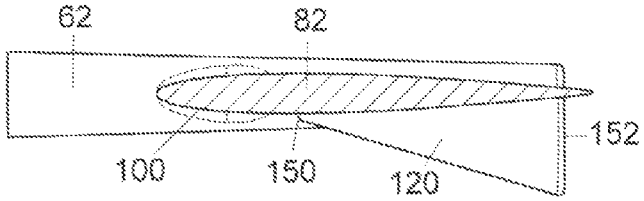

FIG. 4 shows the plan profile and rear views of the hinge 100 and web 120 in a neutral position. The amount of drape of the web 120 can be determined by the amount of pivot to be allowed between the longitudinal axis of the support beam and the longitudinal axis of the vane and its derivation will be described later.

Figure 5A:
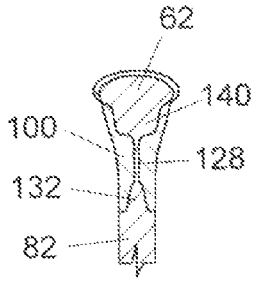
FIGS. 5A-5B are cross-sectional views of FIG. 4A showing the overmolding of the pliable material.

FIG. 5A is a cross-sectional view through the centerline of the hinge 100 and showing how the pliable hinge material 100 is overmolded on the beam hinge base 130 and vane hinge base 132 between the beam 62 and the vane 82. The large amount of hinge material 100 over the connection shaft 128 is what allows the vane 82 to pivot while remaining torsionally biased to the neutral position.

Figure 5B:
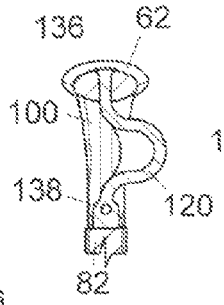
Figure 5C:
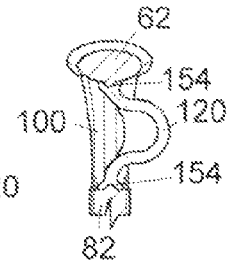
FIG. 5C is a cross-sectional view of FIG. 4A taken at FIG. 5B showing an alternate configuration for the overmolding of the web pliable material.

FIG. 5B shows a cross-sectional view through the web 120 according to the first embodiment. It can be seen that the pliable web material 120 extends through the support beam 62 in the web connection slot 136 and the web 120 is thickened where it covers the web connection rail 138 on the vane 82. FIG. 5C illustrates an additional embodiment of the web connection using only a bump 154 on the vane 82 and support beam 62. This approach is used in the situation where there is sufficient fusion bonding between the pliable and rigid materials that no additional mechanical bonding is necessary. While the embodiments shown herein use separate hinge 100 and web 120 structures this does not preclude the use of a system in which both are merged together as a single unit.

FIGS. 6A, 6B, 6C, and 6D show the pliable hinge 100 and pliable web 120 with the vane 82 pivoted to an optimum angle of attack. It can be seen the web 120 is stretched out essentially flat with allowance for the bends along the fused edges. When the vane 82 is pivoting from its neutral position and has not yet reached the optimum angle of attack the pivoting is resisted only by the pliable hinge 100 but once the optimum angle of attack is reached the web 120 starts to resist the pivoting action and effectively stops it. Testing has revealed the total lifting force on an individual vane is between 4 and 5 pounds.

At the point of optimum angle of attack about half of the lifting force is carried by the hinge 100 and the remainder by the web 120. Since there are two hinges 84, 86 and webs 120, 122 per vane 82 the resultant load to be resisted by the web 120 is about 1 pound along its entire connection bond. As it is not possible for a swimmer to kick more than twice as hard as was determined by testing it is clear there are many pliable materials which can handle the stresses applied in this application without undue distortion. When in the flexed position the web portion 120 serves to reduce the tip vortices in addition to holding the vane 82 at the correct angle of attack. The reduction of tip vortices effectively increases the aspect ratio over the physical aspect ratio. A side benefit of this is the channelizing of the thrust which reduces the turbulence behind the swimmer thus reducing the stirring up of silt when near a silty surface. Any underwater photographer can explain the importance of keeping the water as free of silt as possible. Stirred up silt reduces visibility in the water, sometimes to the point of totally obscuring one's path. Stirred up silt has been the root cause of the death of many scuba divers.

Figure 7C:
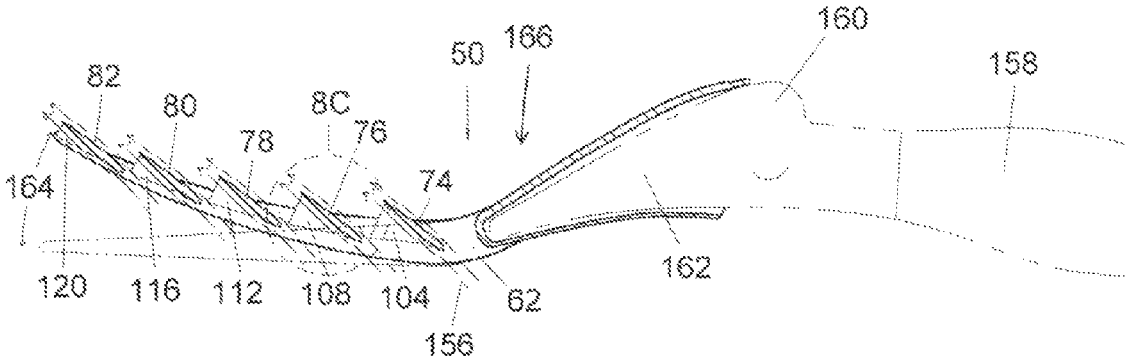

FIGS. 7A, 7B and 7C show the combined function of the support beams 62, 64 and vanes during a typical swimming stroke for the first embodiment of the novel fin 50 used with the leg 158, heel, and foot 162 and the direction of foot motion 166. For the purposes of this discussion up will be taken as toward the top of the page or toward the heel 160 of the swimmer since most swimming occurs with the swimmer's face down. FIG. 7A shows a typical up stroke using the invention, FIG. 7B shows a neutral or coasting position where no upward or downward force is being applied yet the swimmer is still moving forward, and FIG. 7C shows a typical downward stroke.

Figure 8A:
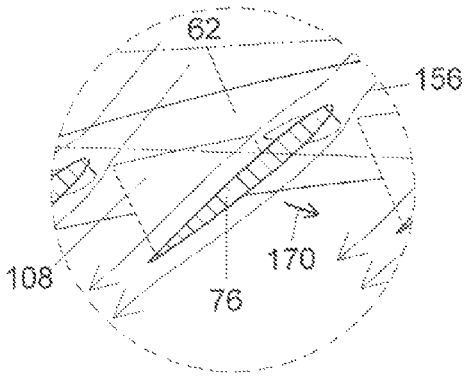
FIGS. 8A, 8B, and 8C show the flow around individual vanes from FIGS. 7A-7C.
Figure 8B:
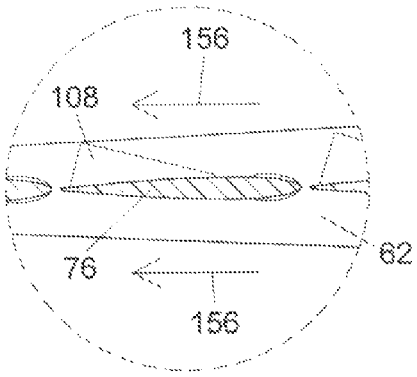

In the neutral position shown in FIG. 7B all of the vanes are aligned with the support beam thus minimizing the overall drag created by the swim fin 50. There is virtually no interaction between the flow 156 and the vanes 74-82 as shown in FIG. 8B. During the upstroke in FIG. 7A the foot travels in an upward and forward direction 166 relative to the water. The vanes deflect to an optimum angle of attack with the flow It has been found that this optimum angle of attack to the flow for a NACA 0009 airfoil is approximately 4 degrees. To account for the dynamics of swimming it was necessary to determine the optimum angle of attack relative to the longitudinal axis of the support beams by physical testing which resulted in an angle of about 40 degrees on a swim fin with a fixed downward support beam deflection 168 of 30 degrees.

Support beam flexibility is an important consideration in this invention. If the beam supports 62, 64 are too stiff there is undue ankle stress. If the beam supports 62, 64 are too flexible the vanes 74-82 when aligned at optimum angle of attack will not have sufficient offset to be efficient. It is known that as airfoils get closer together the efficiency of the pair decreases. Also it is known that staggering the upper airfoil forward of the lower one improves the efficiency of the pair. This invention provides for a substantial forward stagger of the vanes 74-82 and, with rigid support beams, has a reasonable vertical spacing of vanes 74-82. Rigid support beams contribute to ankle stress so it is necessary to use semi-flexible support beams 62, 64 with a maximum flexure 164 of no more than 30 degrees. For the purpose of the illustrations the first embodiment shows a beam maximum flexure 164 of 30 degrees which is greater than should be used in practice.

Figure 4C:
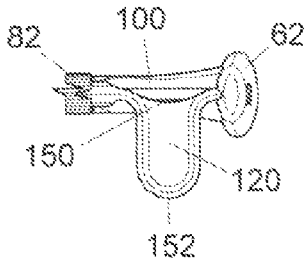
Figure 6A:
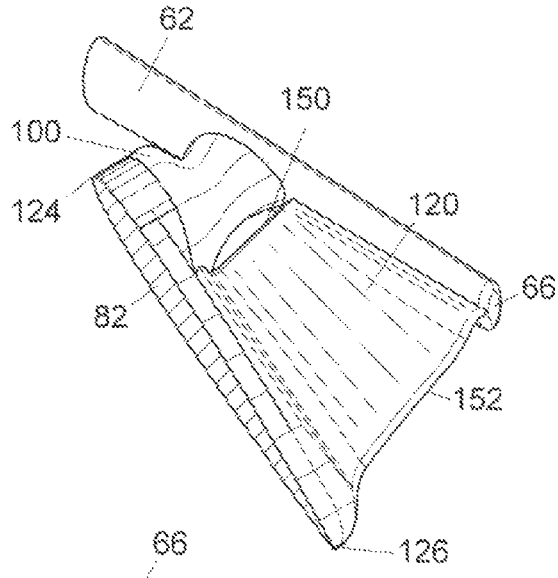
FIGS. 6A, 6B, 6C and 6D are isometric, plan, profile and side views of the novel support beam and vane interconnection of the preceding figures in a rotated position.
Figure 6B:
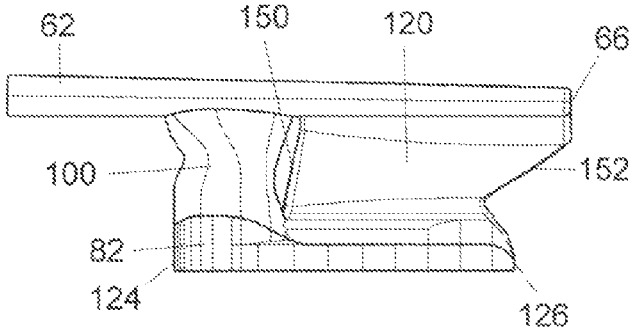
Figure 6C:
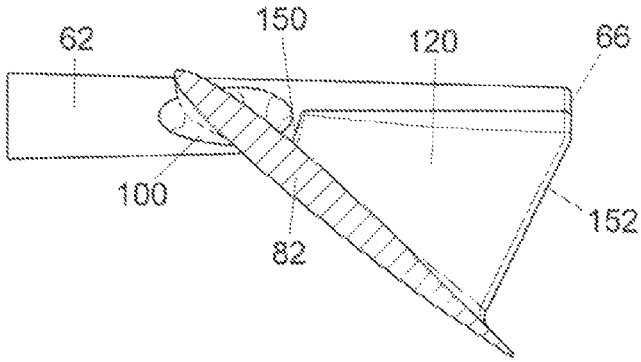
Figure 6D:
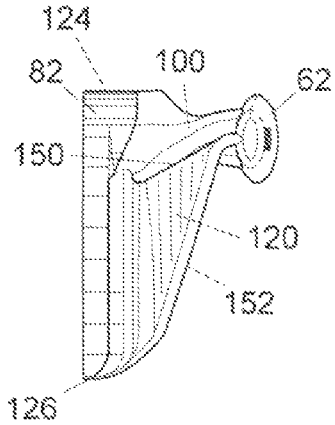

Given the flexing of the support beam, it is necessary to set the optimum angle of attack for each vane 74-82 so it will be proper with the support beam 62 is in the flexed position as shown in FIG. 7A or FIG. 7C. It can be seen that while each vane 74-82 is set at a different angle to the support beam 62 they all are parallel to each other. This is accomplished by setting the drape of the web for each vane using common geometrical relationships as follows. First the optimum angle of attack is determined by experimental processes. Then the normal flexure of the support beam 62 is determined. Next, based on the location of each vane along the support beam determine the local support beam 62 flexure angle at each vane 74-82 location. The optimum angle of attack less the local support beam flexure angle is the individual vane rotation angle to be set as shown in FIG. 6C. The length of the web from the longitudinal axis of the support beam to the center plane of the rotated vane is then determined for the front of the web and the rear of the web accounting for the limits of curvature of the pliable material along the edges. Next calculate the amount of drape required to fit the pivoted web distance into the non pivoted geometry as illustrated in FIGS. 4C and 5B.

Figure 8C:
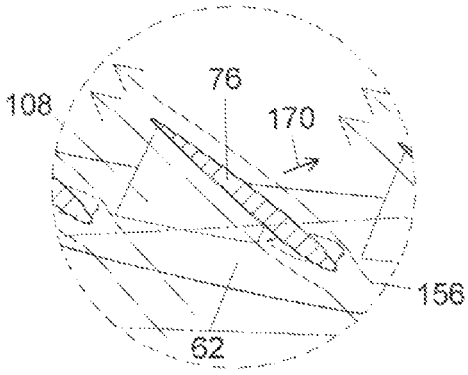

FIG. 7A shows that all vanes 74-82 are optimally aligned with the flow 156 since they are each aligned appropriately to the support beam 62 in the flexed position. Because there is a small angle of attack between the flow 156 and the vanes 74-82 then hydrodynamic lift 170 is generated generally in the direction of travel of the swimmer as shown in FIGS. 8A, and 8C. FIG. 7C shows the flow 156 for the downstroke, and it can be seen that the beam deflection angle 168 combined with the support beam flexure angle 164 and properly proportioned webs 104, 108, 112, 116, 120 serves to allow the optimum angle of attack on the downstroke also.

Second Embodiment

Figure 9A:
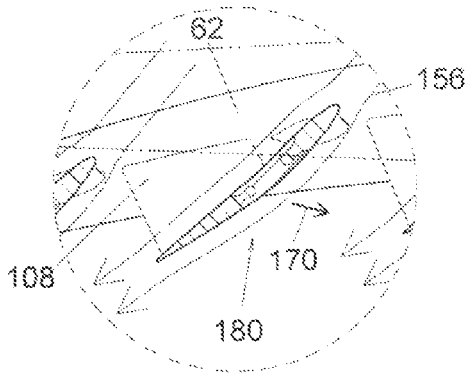
FIGS. 9A, 9B and 9C show the flow around individual vanes from FIG. 10A-10C.
Figure 9B:
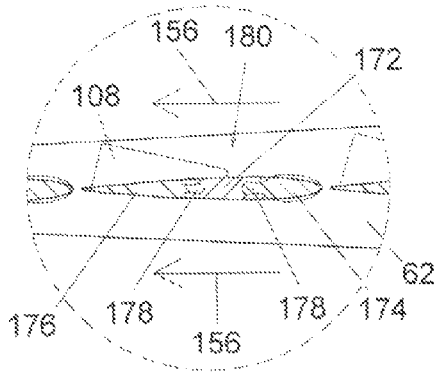
Figure 9C:
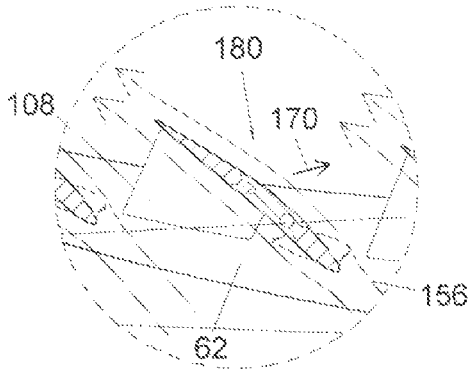
Figure 10C:
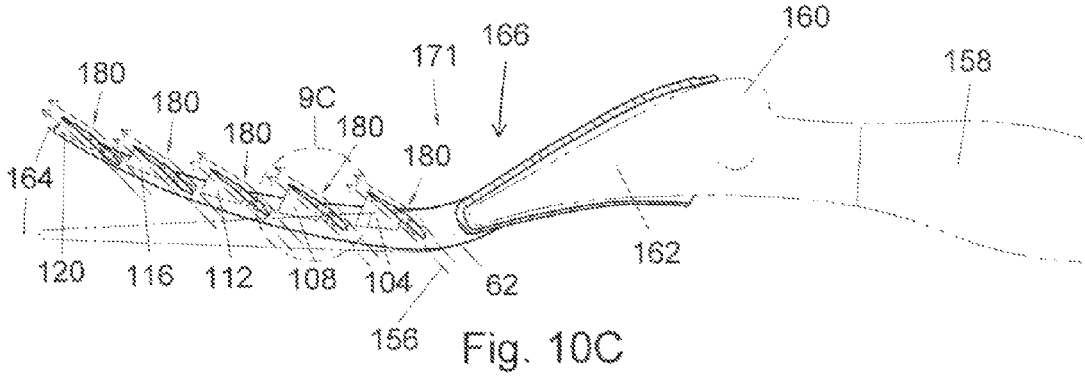

FIGS. 10A, 10B and 10C show the operational sequence of another embodiment of the invention using symmetrical flexible vanes in the fixed support beam fin 171 used with the leg 158, heel, and foot 162 and the direction of foot motion 166. FIGS. 9A, 9B and 9C show the flow 156 around individual vanes from FIG. 10A-10C. The second embodiment is similar to the first except the vanes 180 are flexible along their lateral axes at about the 40% chord distance. The flexible connector 172 is a pliable material overmolded onto a rigid leading edge 174 and rigid trailing edge 176 as illustrated in FIG. 9B. To facilitate a stronger bond between the two materials a rail system 178 similar to the web connection rail 138 of FIG. 2C. The function of the swim fin in this embodiment is substantially similar to the function of the first embodiment except the flexure of the vanes 180 effectively creates a reversibly asymmetric hydrofoil with a higher lift to drag ratio than in the first embodiment.

FIGS. 10A, 10B, 10C illustrate the stroke dynamics which is similar to that of the first embodiment with the exception of the additional curvature of the flexible vane 180 which according to computational fluid dynamic calculations improves the lift to drag ratio by 290% over that of the symmetrical rigid vane.

Figure 13:
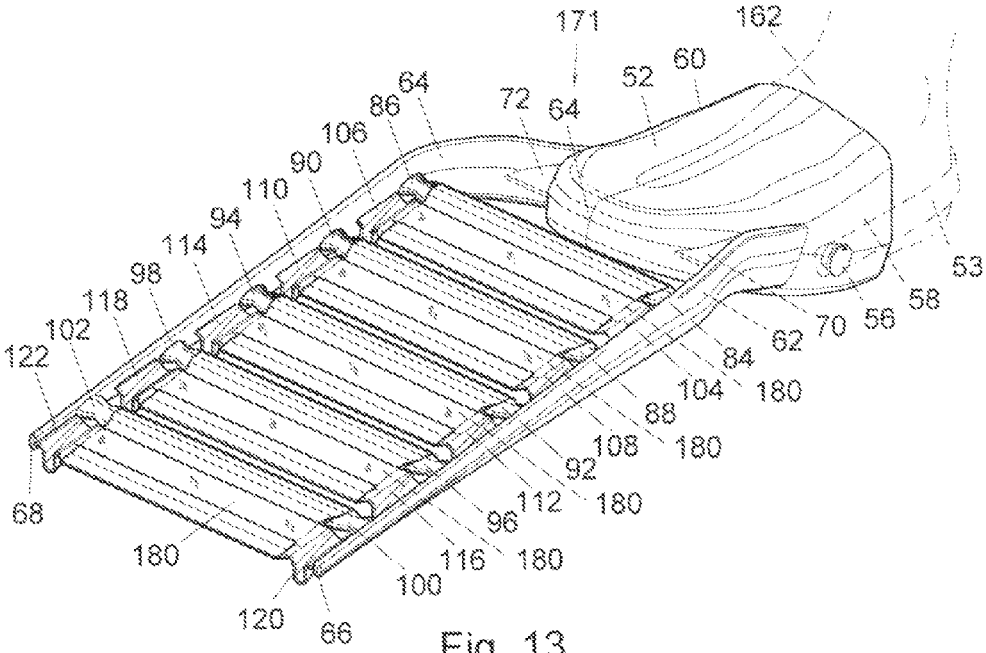
FIG. 13 is an isometric view of an alternate embodiment of the swim fin with flexible vanes.

FIG. 13 shows an isometric view of the second embodiment of the invention in a neutral state. This is similar to the first embodiment except for the flexible vanes 180 which improve the overall lift drag ratio. The flexible vane operation is shown and described in reference to FIGS. 9A-10C.

Third Embodiment

Figure 11:
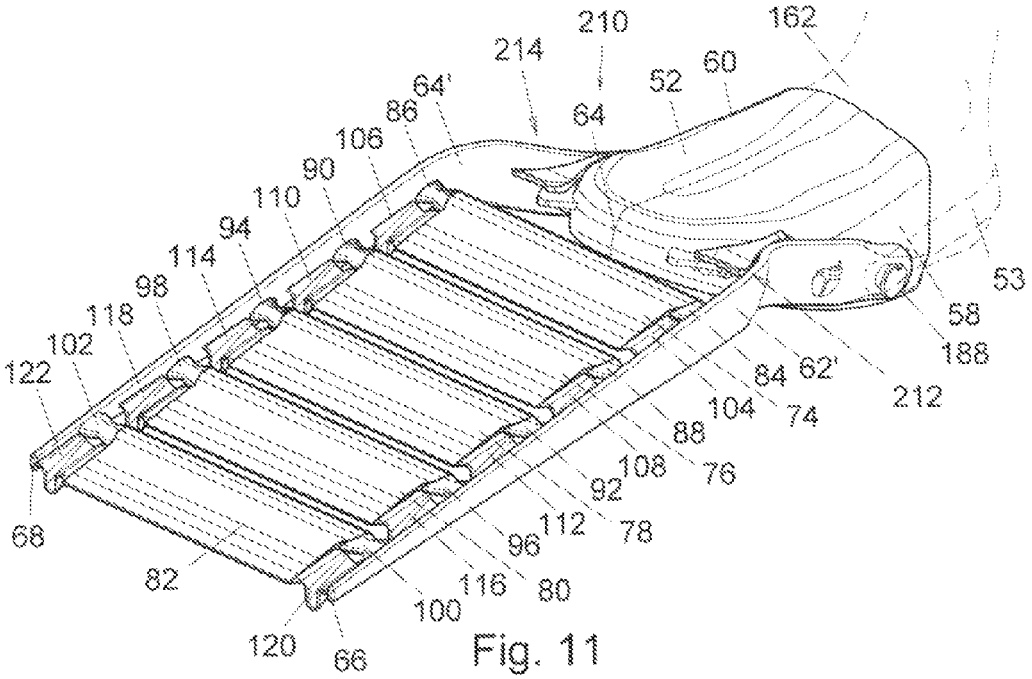
FIG. 11 is an isometric view of an alternate embodiment of the swim fin with pivotally attached support beams in the operating latched position.

FIG. 11 shows a third embodiment 210 which is similar to the first embodiment with the entire support beam and vane structure being pivotally attached to the foot pocket 52 and secured by dual latch assemblies 212, 214 on the sides of the foot pocket 52. The latch assemblies 212, 214 are detailed in FIGS. 16-20B.

Figure 12:
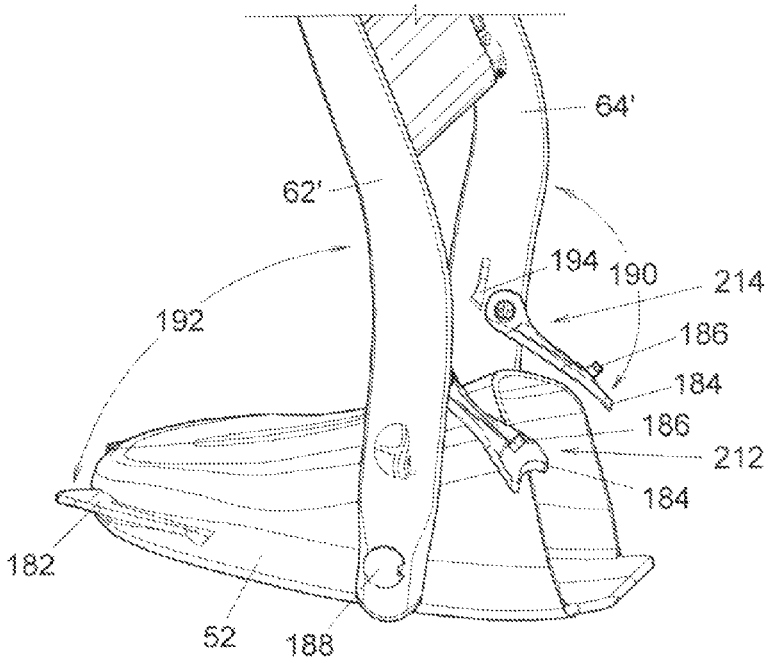
FIG. 12 is an isometric view of an alternate embodiment of the swim fin with pivotally attached support beams in the un-latched and rotated walking position.

FIG. 12 shows the third embodiment in its pivoted up position. In this position it is possible for the swimmer to walk on land or a boat without stumbling over the large propulsion surface in front of him. Pivotally attached propulsion surfaces for swim fins exist in the public domain. U.S. Pat. No. 4,981,454 by Klein, which is incorporated by reference is an example which uses a toe located latch.

The latching mechanism of the third embodiment operates through a captive ledge system much like the dead bolt on a door. The difference is that in this case the deadbolt is fixed and the pocket it slides into is movable. The support beams 62', 64' are pivotally attached to the foot strap pegs 56 (FIG. 1) on the foot pocket 52.

Referring to FIGS. 11-16 duplicate replacement foot strap pegs 188 are attached to the outside of the support beams 62', 64' to replace the foot strap pegs 56 (FIG. 1) used by attaching the support beams 62', 64'. When rotated to the closed position as in FIG. 11 the support beams 62', 64' being elliptical in cross section collide with the latch ledge 182 which forces the support beams 62', 64' to separate sufficiently to slide over the latch ledges 182 until the latch slot 194 (shown in FIGS. 12 and 16) in the support beams 62', 64' align with the latch ledges 182. At this point the support beams 62', 64' snap back into their original alignment captivating the latch ledge 182 and preventing the support beams 62', 64' from further movement. At this point the cam lever 184 is secured by slipping the cam lock clip 186 over the latch ledge 182. The support rails are then held in position by the stiffness of the support beams 62', 64' which are held in position by the foot strap pegs 56 and vanes 74-82 which are fused to the support beams 62', 64' through the pliable hinges 84-102. The process for unlatching the latch ledge 182 is described in reference to FIGS. 18A-20B.

The cam lever 184 rotation is shown by arrow 190, and the support beam(s) 62', 64' rotation 192 is shown in FIG. 12.

Fourth Embodiment

Figure 14:
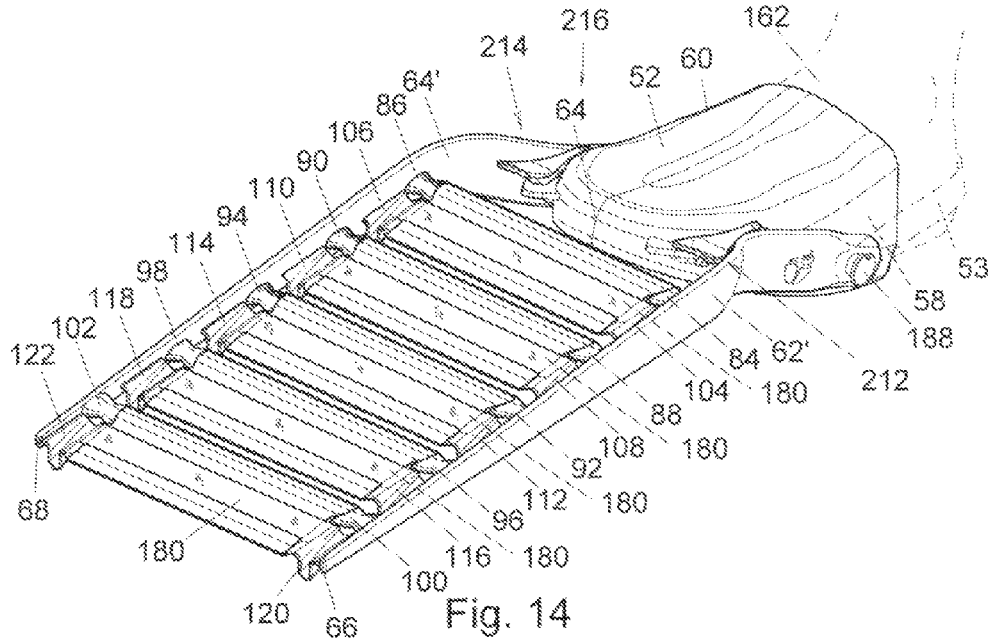
FIG. 14 is an isometric view of an alternate embodiment of the swim fin with flexible vanes and pivotally attached support beams in the operating latched position.

FIG. 14 illustrates isometric view of the fourth embodiment 216 of my invention in its neutral state. This is similar to the third embodiment except for the flexible vanes 180 which improve the overall lift drag ratio. The flexible vane operation is described in reference to FIGS. 9A-10C.

Figure 15:
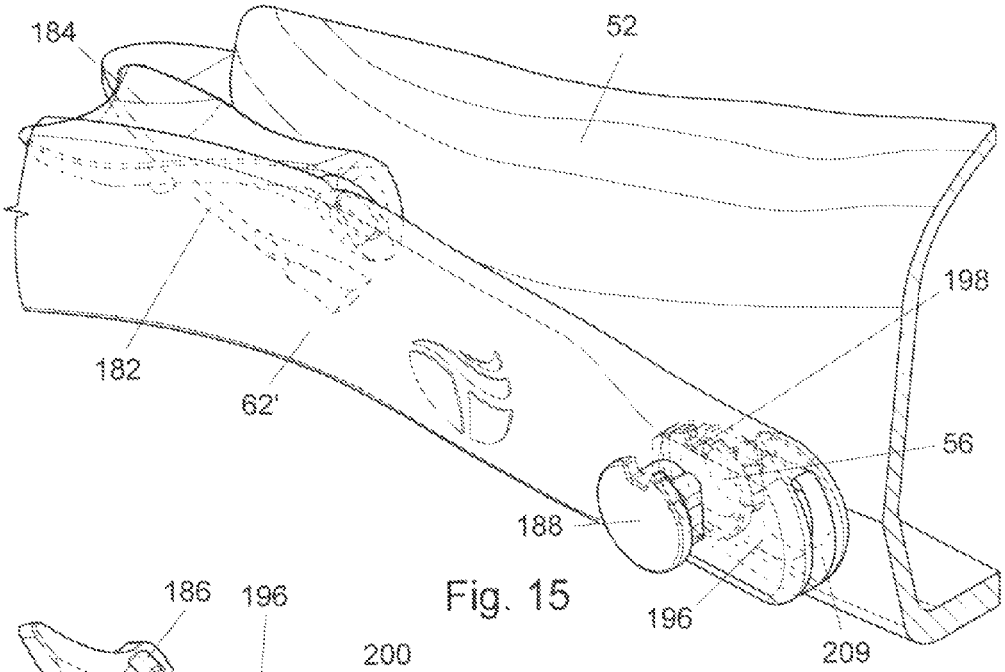
FIG. 15 is an isometric view of a latching system for the pivotally attached support beam embodiment with the cam lever in the latched position.

FIG. 15 shows the latched position of one latching application for embodiments three and four. The support beam 62' can be pivotally attached at the receptacle 196 for the foot strap peg 56 to the foot pocket 52 at the foot strap peg 56. The geometry of the foot strap receptacle 196 is shown more clearly in FIG. 16. Since the foot strap peg 56 on the foot pocket is covered by the support beam 62' the support beam 62' has a replacement foot strap peg 188 to serve the purpose of the original foot strap peg 56. The support beam 62' can be attached to the foot pocket 52 by aligning the tab 200 on the foot strap receptacle 196 with the keyway 198 of the foot strap peg 56 and sliding it on. Once the foot strap peg 56 is inserted into the foot strap receptacle 196 on the support beam 62' the support beam 62' is slid laterally on the foot strap peg 56 until the foot strap peg 56 is aligned with the replacement foot strap peg 188 at which point the support beam is in its operating position and may be rotated to a horizontal latched position as described with FIG. 12.

The cam lever 184 is a beveled rotating cam which in the latched position lies between the support beam 62' and the foot pocket 52 without exerting any influence on either.

Figure 16:
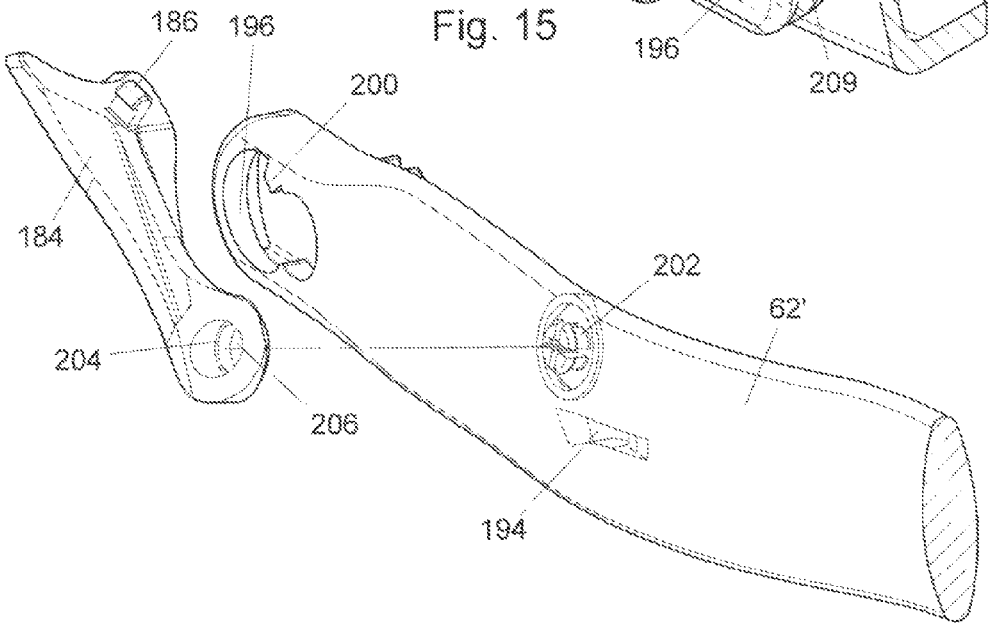
FIG. 16 is an exploded isometric view of a latching system for the pivotally attached support beam embodiment with the cam lever in the un-latched position.

FIG. 16 is a view of the support beam 62' and cam lever 184 separated to show the underlying cam lever post 202 and a clearer view of the latch ledge slot 194 and foot strap peg receptacle 196. The latch ledge slot 194 in the support beam 62' which accepts the latch ledge 182 on the foot pocket 52 is shaped to match the shape of the latch ledge 182. The particular shape of the slot 194 and the latching ledge 182 in this embodiment is based on an existing foot pocket 52 with a latch ledge 182 of this geometry. Other shapes of the latching ledge 182 would also suit this purpose and can have additional benefits. Of key importance to this invention is the top and bottom surfaces of both the latch ledge 182 and slot 194 need to be nearly parallel and near perpendicular to the axis of the shear force created at the interface of the two features when the swim fin is in active use. The latch ledge 182 must be sufficiently strong to resist the shear forces created. This is estimated at about 40 pounds per support beam 62' perpendicular to the longitudinal axis of the support beam 62'. Depending on the spacing between the latch ledge 182 and the foot strap peg 56 the actual shear force can vary substantially.

The cam lever 184 has three primary design features which will be described more thoroughly in reference to FIGS. 17-20B. In embodiments three and four the cam lever 184 can be pivotally attached to the support beam 62' by a press fit over a cam lever post 202 which is molded into the support beam 62'. Since this is a plastic material the lever post 202 is somewhat flexible so press fitting the cam lever 184 over the lever post 202 will cause the pegs to deflect somewhat then snap back to their original shape after the shoulder 204 in the cam pivot hole 206 has been reached. FIG. 18A shows the cam lever 184 in its installed condition. This example of cam lever 184 connection does not preclude other attachment methods such as a simple screw and washer.

The foot strap peg receptacle 196 is also shown in FIG. 16 showing the tab 200 to be aligned with the keyway 198 on the foot strap peg 56 before the foot strap peg 56 is inserted into the receptacle 196 and slid forward to its operational position. The opening 209 in the back of the support beam 62' at the receptacle 194 is simply for the purpose of making the device injection moldable.

FIG. 17 shows the cam lever 184 in a locked position as viewed from directly above. The broad upper surface 207 of the cam lever serves to channelize or normalize the flow between the foot pocket 52 and support beam 62'. The locking clip 186 is shown engaged over the edge of the latch ledge 182 to prevent the cam lever 184 from moving when the swim fin is in use. It can be seen the latch ledge 182 is well seated in the latch ledge slot 194 in this configuration preventing the support beam from rotating out of this position.

Figure 19A:
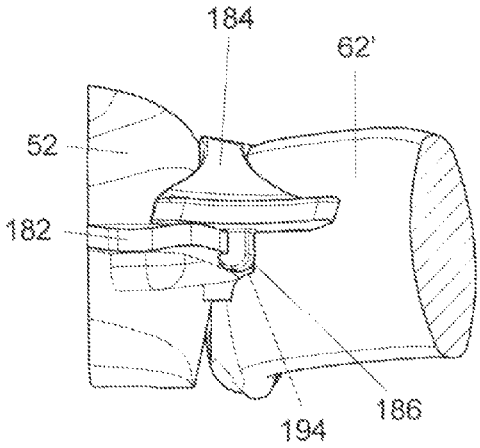
FIG. 19A is an end view of the latching system for the pivotally attached support beam embodiment shown in FIG. 17 with the cam lever in the latched position.
Figure 19B:
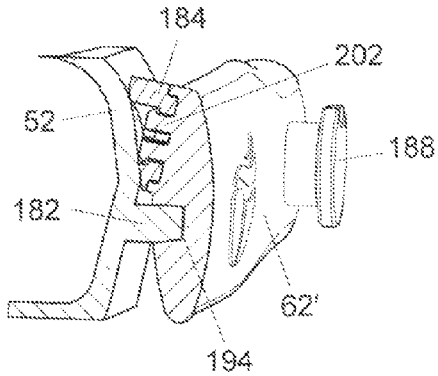
FIG. 19B is a section view as shown in FIG. 17 of a latching system for the pivotally attached support beam embodiment with the cam lever in the latched position.

FIG. 19A is a view of FIG. 17 from the front showing the cam lever 184 in the locked position. Notice the lock clip 186 has captured the edge of the latch ledge 182 and the latch ledge 182 is securely seated in the latch slot 194. FIG. 19B is a cross-sectional view of FIG. 17 through the axis of the cam latch post 202 clearly showing the tapered nature of the cam and how it fits between the support beam 62' and foot pocket 52 without exerting any force on either. Also shown in FIG. 17 is the foot strap peg 56 seated in the foot strap peg strap receptacle 196 pivotally fixing the end of the support beam 62'. Molded to the side of the support beam 62' is the replacement foot strap peg 188 which is used to fasten the commonly available foot strap 53.

FIGS. 18A and 18B show a view from above illustrating the effect of rotating the cam lever 184 up. This upward rotation pushes the support beam 62' away from the foot pocket 52 releasing the latch ledge 182 from the ledge slot creating a gap 208 as shown in FIG. 18B, thus allowing the support beam 62' to rotate freely upward as illustrated in FIG. 12.

Figure 20A:
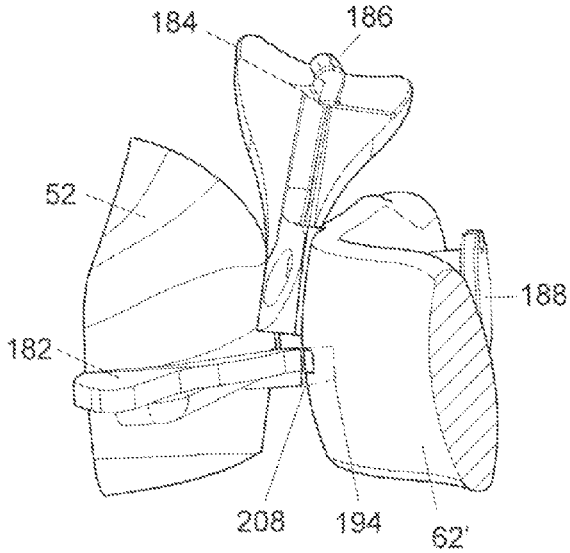
FIG. 20A is an end view of the latching system for the pivotally attached support beam embodiment shown in FIGS. 18A-18B with the cam lever in the un-latched position.
Figure 20B:
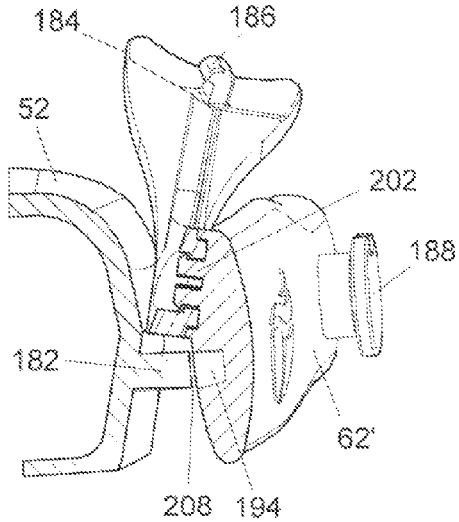
FIG. 20B is a cross-section view as shown in FIGS. 18A-18B of a latching system for the pivotally attached support beam embodiment with the cam lever in the un-latched position.

FIG. 20A shows how the thicker portion of the cam 184 is pressed against the side of the foot pocket 52 increasing the gap 208 between foot pocket 52 and the support beam 62'. FIG. 20B is a cross-sectional view through the axis of the cam latch 184 clearly showing the thicker portion of the cam and how it presses against the foot pocket 52 forcing the support beam 62 and foot pocket 52 apart and consequently removing the latch ledge 182 from the latch slot.

While the invention describes a two step over molding process, the invention can be practiced with a three step process where the foot pocket is molded of a material other than the material used in the vanes, hinges and webs.

Although the embodiments describe the invention for use with swim or sport fins, the invention can use the hydrofoil vanes in other water applications, such as but not limited to boats, paddles, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A fin apparatus for increasing efficiency of a swimmer or diver during self propulsion through water, comprising:

a plurality of vanes arranged in a ladder configuration with the vanes in parallel with one another, each vane having a left end and a right end;

two side beams, each arranged to both side ends of the ladder configuration of vanes;

a plurality of pliable hinges that attach ends of the vanes to the side beams, the hinges allowing the vanes to rotate on a lateral axis during a kick stroke and be resisted by the pliable hinges, wherein each of the pliable hinges include: a generally cylindrical or elliptical configuration with concave curved sidewalls; and a plurality of flexible webs that attach the ends of the vanes to the side beams, the flexible webs allowing for limiting maximum rotation of the vanes.

2. The fin apparatus of claim 1, wherein the pliable hinges are selected from one of the group comprising: rubber, silicone rubber, polyvinylchloride, Polyurethane, Polybutadiene, Chlorosulphonated Polyethylene, and neoprene.

3. The fin apparatus of claim 1, wherein the flexible webs are selected from one of the group comprising: rubber, silicone rubber, polyvinylchloride, Polyurethane, Polybutadiene, Chlorosulphonated polyethylene, and neoprene.

4. The fin apparatus of claim 1, wherein the side beams are selected from one of the group comprising: Polyvinyl chloride, polypropylene, Acrylonitrile butadiene styrene, nylon, polyethylene, rubber and neoprene.

5. The fin apparatus of claim 1, wherein each of the vanes is a flexible vane that flexes in a lateral axis direction.

6. The fin apparatus of claim 1, wherein each of the vanes are selected from one of the group comprising: Polyvinyl chloride, polypropylene, Acrylonitrile butadiene styrene, nylon, polyethylene, rubber and neoprene.

7. The tin apparatus of claim 1, wherein each of the pliable hinges include:

a connection shaft attached at one end to one of the side beams and a second opposite end attached to one of the ends of the vane; and a pliable material over the connection shaft.

8. The fin apparatus of claim 1, wherein the side beams are flexible side beams.

9. A fin apparatus for increasing efficiency of a swimmer or diver during self propulsion through water, comprising:

a plurality of vanes arranged in a ladder configuration with the vanes in parallel with one another, each vane having a left end and a right end;

two side beams, each arranged to both side ends of the ladder configuration of vanes;

a plurality of pliable hinges that attach ends of the vanes to the side beams, the hinges allowing the vanes to rotate on a lateral axis during a kick stroke and be resisted by the pliable hinges, wherein each of the pliable hinges has a generally cylindrical or elliptical configuration with concave curved sidewalls, and each of the flexible webs has a generally trapezoidal configuration; and a plurality of flexible webs that attach the ends of the vanes to the side beams, the flexible webs allowing for limiting a maximum rotation of the vanes.

10. A fin apparatus for increasing efficiency of a swimmer or diver during self propulsion through water, comprising:

a plurality of vanes arranged in a ladder configuration with the vanes in parallel with one another, each vane having a left end and a right end;

two side beams, each arranged to both side ends of the ladder configuration of vanes;

a plurality of pliable hinges that attach ends of the vanes to the side beams, the hinges allowing the vanes to rotate on a lateral axis during a kick stroke and be resisted by the pliable hinges;

a plurality of flexible webs that attach the ends of the vanes to the side beams, the flexible webs allowing for limiting a maximum rotation of the vanes a foot pocket attached to one end of the side beams; and a pivoting portion for allowing the side beams with the vanes to flip up relative to the foot pocket.

11. A fin apparatus for increasing efficiency of a swimmer or diver during self propulsion through water, comprising:

a plurality of flexible vanes arranged in a ladder configuration with the vanes in parallel with one another, each vane having a left end and a right end;

two side beams, each arranged to both side ends of the ladder configuration of vanes;

a plurality of pliable hinges that attach ends of the vanes to the side beams, the hinges allowing the vanes to rotate on a lateral axis during a kick stroke and be resisted by the pliable hinges, wherein each of the pliable hinges has a connection shaft attached at one end to one of the side beams and a second opposite end attached to one of the ends of the vane, and a pliable material over the connection shaft, and wherein each of the pliable hinges has a generally cylindrical configuration with concave curved sidewalls; and a plurality of flexible webs that attach the ends of the vanes to the side beams, the flexible webs allowing for limiting a maximum rotation of the vanes, each of the flexible webs has a generally trapezoidal configuration.

* * * * *